US010252836B2

(12) United States Patent
Geldard

(10) Patent No.: US 10,252,836 B2
(45) Date of Patent: Apr. 9, 2019

(54) APPLICATOR APPARATUS, MOUTH FILL DEVICES, COLLAPSIBLE CONTAINERS AND METHODS

(71) Applicant: Stephen Frank Charles Geldard, Corte Madera, CA (US)

(72) Inventor: Stephen Frank Charles Geldard, Corte Madera, CA (US)

( * ) Notice: Subject to any disclaimer, the term of this patent is extended or adjusted under 35 U.S.C. 154(b) by 0 days.

(21) Appl. No.: 15/266,921

(22) Filed: Sep. 15, 2016

(65) Prior Publication Data

US 2017/0101222 A1 Apr. 13, 2017

Related U.S. Application Data

(60) Provisional application No. 62/239,215, filed on Oct. 8, 2015, provisional application No. 62/384,710, filed on Sep. 7, 2016.

(51) Int. Cl.
*B65D 25/40* (2006.01)
*B65D 23/04* (2006.01)
(Continued)

(52) U.S. Cl.
CPC ..... *B65D 25/40* (2013.01); *B05B 11/0038* (2018.08); *B05B 11/0056* (2013.01);
(Continued)

(58) Field of Classification Search
CPC ... B65D 25/40; B65D 23/04; B05B 11/00412; B05B 11/0056; B05B 11/0081; B05B 11/0097
(Continued)

(56) References Cited

U.S. PATENT DOCUMENTS 2,096,397 A 10/1937 Harris
4,311,173 A 1/1982 Sailors, Jr.
(Continued)

FOREIGN PATENT DOCUMENTS

DE 3305898 8/1984
DE 3535986 4/1987
(Continued)

OTHER PUBLICATIONS

Extended European Search Report and dated Oct. 25, 2017 in European Patent Application No. EP16191515.2.
(Continued)

*Primary Examiner* — Timothy L Maust
(74) *Attorney, Agent, or Firm* — Wentsler LLC

(57) ABSTRACT

Applicator apparatus can include a circumferential wall and a support arm movably mounted relative to the circumferential wall. The support arm can include a protrusion extending in an axial direction within an interior passage of the circumferential wall. Methods of assembling the apparatus are provided in further embodiments. Methods of introducing an additive are provided in further embodiments. In further embodiments, a mouth fill device can include a circumferential shroud. In some embodiments, a plurality of apertures can be disposed in a circumferential lip circumscribing an end of the circumferential shroud. In further embodiments, a protrusion can be mounted relative to the circumferential shroud. In further embodiments, a collapsible container or a collapsed container can include a first shell, a second shell, and a circumferential bladder that can have a higher axial collapsibility than both the first shell and the second shell.

20 Claims, 16 Drawing Sheets

(51) Int. Cl.

| | |
|---|---|
| ***B65D 83/00*** | (2006.01) |
| ***B05B 11/00*** | (2006.01) |
| ***B65D 81/32*** | (2006.01) |
| *B05B 15/30* | (2018.01) |
| *B65B 39/04* | (2006.01) |

(52) U.S. Cl.
CPC ..... *B05B 11/0081* (2013.01); *B05B 11/0097* (2013.01); *B05B 11/00412* (2018.08); *B65D 23/04* (2013.01); *B65D 81/3205* (2013.01); *B65D 83/00* (2013.01); *B05B 15/30* (2018.02); *B65B 39/04* (2013.01)

(58) Field of Classification Search
USPC ..... 141/319, 329, 363–366; 222/383.1
See application file for complete search history.

(56) References Cited

U.S. PATENT DOCUMENTS

| | | | | | |
|---|---|---|---|---|---|
| 4,396,045 | A * | 8/1983 | Cain | B65B 39/04 | 141/286 |
| 4,850,403 | A * | 7/1989 | Wiese | B67C 11/02 | 141/95 |
| 5,131,566 | A * | 7/1992 | Bavegems | B65D 47/06 | 141/330 |
| 5,409,146 | A * | 4/1995 | Hazard | B05B 11/3001 | 137/843 |
| 5,526,961 | A * | 6/1996 | Burrows | B67D 1/0835 | 141/286 |
| 5,819,822 | A * | 10/1998 | Schneider | B01D 27/08 | 141/285 |
| 6,142,193 | A | 11/2000 | Sanders | | |
| 6,739,363 | B2 * | 5/2004 | Walter | B67C 11/02 | 141/331 |
| 6,874,550 | B2 * | 4/2005 | Brooker | B64D 11/04 | 141/299 |
| 2002/0066677 | A1 | 6/2002 | Moscovitz | | |
| 2008/0116221 | A1 | 5/2008 | Roth et al. | | |
| 2015/0034680 | A1 * | 2/2015 | Babikian | B05B 11/0097 | 222/321.9 |
| 2016/0256882 | A1 | 9/2016 | Geldard | | |

FOREIGN PATENT DOCUMENTS

| | | |
|---|---|---|
| FR | 2477101 | 9/1981 |
| WO | 9121605 | 6/1997 |
| WO | 9726210 | 7/1997 |
| WO | 2011029731 | 3/2011 |

OTHER PUBLICATIONS

Partial European Search Report and Provisional Report on Patentability dated Jun. 28, 2017 in European Patent Application No. EP16191515.2.

* cited by examiner

APPLICATOR APPARATUS, MOUTH FILL DEVICES, COLLAPSIBLE CONTAINERS AND METHODS

CROSS-REFERENCE TO RELATED APPLICATIONS

This application claims the benefit of U.S. Provisional Application No. 62/239,215, filed Oct. 8, 2015, and U.S. Provisional Application No. 62/384,710, filed Sep. 7, 2016, wherein both provisional applications are entirely incorporated by reference.

FIELD

The present disclosure relates generally to applicator apparatus, mouth fill devices and collapsible containers and methods and more particularly, applicator apparatus for introducing an additive, mouth fill devices for filling a liquid in a container, and collapsible containers to be placed in a collapsed orientation, for example, during storage and shipping.

BACKGROUND

It is known to provide bottles filled with a solution to be dispensed by a spray nozzle. Typically, fabricated bottles are prefilled with a pre-mixed solution that is ready to be dispensed by a consumer. Prefilling the bottles adds significant weight and requires a large packaging volume, thereby increasing the cost and complexity of shipping the bottles. Furthermore, typical bottles require complicated refill procedures (e.g., by use with a funnel using premix solution) if the bottle is to be refilled with additional pre-mixed solution after dispensing the initial quantity of pre-mixed solution shipped with the bottle. Still further, bulk refill containers are typically sold separately that include pre-mixed solution for refilling the bottles. Such bulk refill containers are relatively heavy and require large packaging volume that also increases the cost and complexity of shipping the bulk refill container.

SUMMARY

The following presents a simplified summary of the disclosure to provide a basic understanding of some embodiments described in the detailed description.

In accordance with some embodiments, an applicator apparatus can include a circumferential wall including an interior surface defining an interior passage extending along an axis of the circumferential wall. The applicator apparatus can include a support arm movably mounted relative to the circumferential wall within the interior passage. The support arm can include a first end engaging the interior surface at a first location, a second end engaging the interior surface at a second location spaced from the first location, and a protrusion extending in an axial direction of the axis within the interior passage.

In further embodiments, a method of assembling can include providing an applicator apparatus with a circumferential wall including an interior surface defining an interior passage extending along an axis of the circumferential wall. An additive container can be mounted to a first end portion of the circumferential wall, wherein the additive container includes a container wall defining an interior containment area of the additive container. The container wall includes a target area facing the interior passage. The circumferential wall further defines a second end portion that is opposite the first end portion, and the second end portion defines an opening into the interior passage. The method can include inserting a support arm through the opening and then into the interior passage with a protrusion of the support arm extending in a direction of the axis toward the target area. A first end of the support arm movably engages the interior surface at a first location and a second end of the support arm movably engages the interior surface at a second location spaced from the first location.

In further embodiments, a method of introducing an additive can include positioning a mouth of a liquid container into an interior passage defined by a circumferential wall of an applicator apparatus. An additive container can be attached to the circumferential wall and placed at a dispensing position relative to an opening defined by a mouth of the liquid container. The method can include driving a protrusion relative to the additive container to pierce a target area of a wall of the additive container such that additive drains from an interior containment area of the additive container, through the opening of the mouth and then into an interior containment area of the liquid container.

In further embodiments, a mouth fill device to be mounted with respect to a mouth of a liquid container includes a circumferential shroud circumscribing an axis of the mouth fill device. The circumferential shroud includes an interior surface defining an interior passage extending along the axis. The mouth fill device further includes a circumferential lip circumscribing an end of the circumferential shroud and extending radially away from the axis. The circumferential lip includes a plurality of apertures disposed about the axis.

In further embodiments, a mouth fill device to be mounted with respect to a mouth of a liquid container includes a circumferential shroud circumscribing an axis of the mouth fill device. The circumferential shroud includes an interior surface defining an interior passage extending along the axis. The mouth fill device further includes a protrusion mounted relative to the circumferential shroud and extending within the interior passage.

In further embodiments, a collapsible container includes a first shell including a mouth defining an opening and a first circumferential rim and a second shell including a closed end and a second circumferential rim. The collapsible container includes a circumferential bladder including a first edge sealed to the first circumferential rim and a second edge sealed to the second circumferential rim. The first shell, second shell and circumferential bladder define an interior containment area extending along an axis of the collapsible container. A material of the circumferential bladder includes a lower modulus of elasticity than a material of the first shell and a material of the second shell wherein the axial collapsibility of the circumferential bladder is higher than the axial collapsibility of both the first shell and the second shell.

In further embodiments, a collapsed container includes a first shell including a mouth defining an opening and a first circumferential rim and a second shell including a closed end and a second circumferential rim. The collapsed container further includes an axially collapsed circumferential bladder including a first edge sealed to the first circumferential rim and a second edge sealed to the second circumferential rim. The first shell, second shell and circumferential bladder define an interior containment area extending along an axis of the collapsed container. A material of the circumferential bladder includes a lower modulus of elasticity than a material of the first shell and a material of the second shell wherein the axial collapsibility of the circumferential bladder is higher than the axial collapsibility of both the first shell and the second shell.

BRIEF DESCRIPTION OF THE DRAWINGS

These and other features, aspects and advantages are better understood when the following detailed description is read with reference to the accompanying drawings, in which.

DETAILED DESCRIPTION

Figure 1:
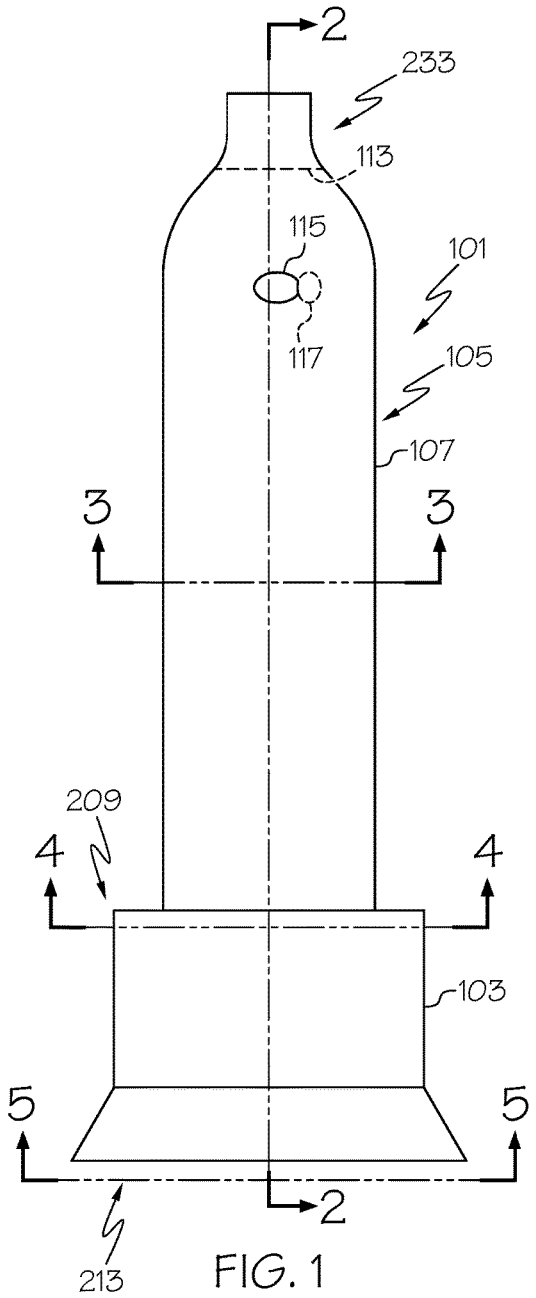
FIG. 1 illustrates an embodiment of an applicator apparatus in accordance with features of the disclosure.

Embodiments will now be described more fully hereinafter with reference to the accompanying drawings in which example embodiments are shown. Whenever possible, the same reference numerals are used throughout the drawings to refer to the same or like parts. However, this disclosure may be embodied in many different forms and should not be construed as limited to the embodiments set forth herein.

Figure 2:
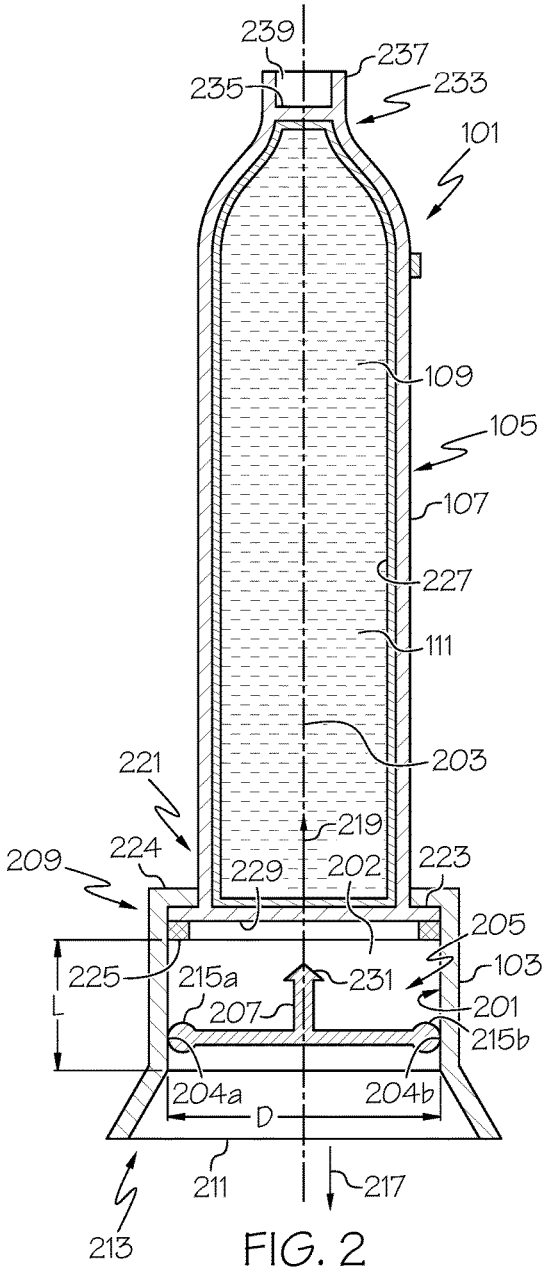
FIG. 2 illustrates a sectional view of the applicator apparatus along line 2-2 of FIG. 1.
Figure 5:
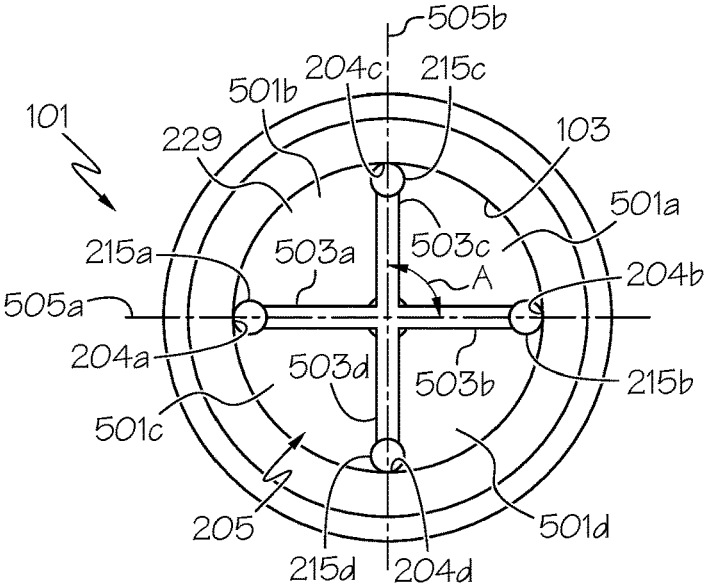
FIG. 5 illustrates a bottom view of the applicator apparatus along line 5-5 of FIG. 1.

As shown in FIG. 1, an applicator apparatus 101 can include a circumferential wall 103. As further illustrated in FIG. 2, the circumferential wall 103 can include an interior surface 201 defining an interior passage 202 extending along an axis 203 of the circumferential wall 103. The axis 203 can comprise the central axis (e.g., symmetrical central axis) or an offset axis (e.g., symmetrical offset axis) that is offset from the central axis. The circumferential wall can include a wide range of shapes and sizes depending on the particular application. For instance, as shown in FIG. 5, the circumferential wall 103 can include a circular cross-section taken along a section perpendicular to the axis 203. Referring to FIG. 2, the interior passage 202 may therefore include a segment including an interior diameter "D". As shown, the interior diameter "D" can be substantially the same along the entire length "L" of the segment. In some examples, other circumferential wall shapes may be provided such as rectangular, triangular or other polygonal shape. In still further examples, the circumferential wall shape may comprise an oblong shape, oval shape or other curvilinear shape and may optionally have a cross section that has the same cross-sectional shape along the entire length "L". Indeed, as shown in the example embodiment, the interior passage 202 may include the same circular cross sectional shape taken along the section perpendicular to the axis 203 along the entire length "L".

As shown in FIG. 2, the applicator apparatus 101 can include a support arm 205 movably mounted relative to the circumferential wall 103 within the interior passage 202. The support arm 205 can comprise a wide range of structures that can span a dimension of the interior passage 202 from a first location 204*a* of the interior surface 201 to a second location 204*b* of the interior surface 201 that is spaced from the first location 204*a*. As shown, the support arm 205 can be designed to support a protrusion 207 relative to the circumferential wall while still providing drainage areas 501*a-d* (see FIG. 5) to allow passage of additive. More particularly, the circumferential wall 103 can define a second end portion 213 that is opposite a first end portion 209, wherein the second end portion defines an opening 211 into the interior passage 202. The drainage areas 501*a-d* allow passage of additive, such as liquid additive, from the first end portion 209, through the interior passage 202 and then through the opening 211. As shown, the protrusion 207 of the support arm 205 can extend in an axial direction 219 of the axis 203 within the interior passage 202. For instance, as show, the protrusion can be aligned with the axis 203 of the circumferential wall 103.

In the illustrated embodiment, the support arm 205 includes a first end 215*a* engaging the interior surface 201 at the first location 204*a*, a second end 215*b* engaging the interior surface 201 at the second location 204*b* spaced from the first location 204*a*. In some examples, the support arm 205 may engage the interior surface 201 at only two locations, such as the diametrically opposed locations 204*a*, 204*b*. In further examples, the support arm may include engagement at any number of locations such as 3 or more locations. Indeed, referring to FIG. 5, the support arm 205 may include a plurality of segments 503*a-d* that each include respective ends 215*a-d* configured to simultaneously engage the interior surface 201 at corresponding locations 204*a-d*. In one example, as shown, the support arm 205 can include a plurality of segments including a first segment 503*a* including the first end 215*a*, a second segment 503*b* including a second end 215*b*. In further examples, as shown, the plurality of segments of the support arm 205 can include a third segment 503*c* including a third end 215*c* engaging the interior surface 201 at a third location 204*c* spaced from the first location 204*a* and the second location 204*b*. As further shown, the plurality of segments can include a fourth segment 503*d* including a fourth end 215*d*, wherein the fourth end 215*d* engages the interior surface 201 at a fourth location 204*d* spaced from the first location 204*a*, the second location 204*b* and the third location 204*c*.

Although not required, in some examples, segments of the plurality of segments of the support arm 205 may be aligned with respect to one another along a common linear axis. For instance, as further shown in FIG. 5, a first two segments 503*a-b* of the plurality of segments 503*a-d* may optionally be aligned along along a first linear segment axis 505*a*. In some further examples, a second two segments 503*c-d* of the plurality of segments 503*a-d* may optionally be aligned along a second linear segment axis 505*b*. The first linear segment axis 505*a* and second linear segment axis 505*b* can intersect one another at a wide range of angles. For instance, as shown, the first linear segment axis 505*a* and the second linear segment axis 505*b* can intersect one another along an angle "A" of 90° although other angles may be provided in further examples.

In the illustrated embodiment, the ends 215*a-d* may optionally comprise a ball or other rounded surface to provide a point contact at the respective location 204*a-d* to minimize friction during a sliding movement of the support arm 205 relative to the interior surface 201 of the circumferential wall 103. Furthermore, in some embodiments, the support arm may be press fit within the interior passage 202. Indeed, an interference fit may exist between a length of the support arm 205 and the interior diameter "D" of the interior passage 202. For instance, with reference to FIG. 5, the length of the support arm 205 from the outermost point of the first end 215*a* of the first segment 503*a* and the outermost point of the second end 215*b* of the second segment 503*b* can be slightly larger than the interior diameter "D" such that the first segment 503*a* and the second segment 503*b* are placed in compression to press the first end 215*a* and the second end 215*b* against the interior surface 201 at respective opposed locations 204*a*, 204*b*. Likewise, the length of the support arm 205 from the outermost point of the third end 215*c* of the third segment 503*c* and the outermost point of the fourth end 215*d* of the fourth segment 503*d* can be slightly larger than the interior diameter "D" such that the third segment 503*c* and the fourth segment 503*d* are placed in compression to press the third end 215*c* and the fourth end 215*d* against the interior surface 201 at respective opposed locations 204*c*, 204*d*. Providing the support arm 205 press fit within the interior passage 202 can allow selective placement of the support arm 205 relative to the circumferential wall 103 wherein the friction enhanced by the normal force applied by each of the ends 215*a-d* allow maintenance of the support arm 205 at the desired location of the interior passage 202. Furthermore, the ends 215*a-d* of the support arm 205 may optionally be slidingly engaged with the interior surface 201. As such, axial adjustment of the position of the support arm along the axis 203 may be achieved by applying a force to the support arm 205 to overcome the friction forces applied to the ends 215*a-d*, thereby resulting in sliding movement of the ends 215*a-d* of the support arm relative to the interior surface 201. Once the desire location is obtained, the force can be removed from the support arm 205 wherein the friction forces being applied to the ends 215*a-d* of the support arm 205 again help maintain the desired location of the support arm 205 within the interior passage 202.

As shown in FIG. 2, the opening 211 to the interior passage 202 may optionally be flared in an outward direction 217 extending from the first end portion 209 to the second end portion 213. The flared nature of the interior passage, if provided, can help insert the support arm 205 into the interior passage 202 and can optionally help guide a finger, mouth of a bottle, or other object into the interior passage 202 to press the support arm 205 along the axis 203 toward the first end portion 209.

The support arm 205 and/or the circumferential wall 103 can be fabricated from a wide range of materials such as plastic (e.g., hemp plastic), bagasse, molded fiber, bamboo fiber or other materials that can be used economically and may have biodegradable properties.

As shown in FIGS. 1-4, the applicator apparatus 101 can also include an additive container 105 mounted to the first end portion 209 of the circumferential wall 103. The additive container 105 may be mounted to the first end portion 209 in a wide variety of ways such as integrating (e.g., with a sonic weld) the additive container 105 to the first end portion 209. In further examples, an adhesive may be used to mount the first end portion 209 to the additive container 105. In addition or alternatively, mechanical clamps or fasteners may be employed. For instance, as shown in FIG. 2, a first end portion 221 of the additive container 105 may include an optional circumferential flange 223 that may be clamped to a shoulder 224 of the first end portion 209 of the circumferential wall 103 with a clamp ring 225. The clamp ring can include an open interior area to allow additive to flow therethrough during a dispensing operation. At the same time, the clamp ring can be press fit against the interior surface 201 within the interior passage 202 to trap and clamp the circumferential flange in place.

The additive container 105 can include a container wall 107 defining an interior containment area 109 of the additive container 105. The container wall 107 can include a wide range of materials such as polymeric, elastomeric, metal, resin or other materials. In some examples, the container wall 107 can comprise a flexible material although a rigid material may be provided in further examples. In one particular example, the container wall 107 can comprise a metallic flexible foil, film, or thin flexible plastic that presents the container wall 107 with flexible and/or collapsible properties. In some further embodiments, the container wall 107 can include biodegradable cellophane and cellophane film or sheet material. There are a wide range of plastic films that may be used for the container wall 107 that are thin, inexpensive and derived from plastic which also have biodegradable additives. In some embodiments, the container wall 107 can comprise materials such as biodegradable, compostable plant based films. Eco-friendly films made from cellulose acetate, biodegradable polythene film, biopolymer plant sugar PLA. Furthermore, the container wall 107 may include TDPA "Totally Degradable Plastic Additives" in some embodiments. Typically, PLA, biodegradable packaging can comprise a set of polymers that are derived from renewable raw materials like starch (e.g., corn, potato, tapioca etc.), cellulose, soy protein, lactic acid, etc. Such materials are not hazardous in production and readily decompose back into carbon dioxide, water, biomass etc, when discarded properly.

In some embodiments, providing a flexible and/or collapsible container wall 107 can help reduce weight of the applicator apparatus 101 and, in some examples, can help dispense all of the additive from an interior containment area by applying force to collapse the container wall 107 during a dispensing operation of the additive within the additive container 105.

As shown in FIGS. 2 and 5, the container wall 107 includes a target area 229 facing the interior passage 202 to be pierced by the protrusion 207 upon a movement of the support arm 205 relative to the circumferential wall 103. As shown, the protrusion 207 can optionally include a conical puncture head 231 tapering from a relatively wide base to a pointed tip. The pointed tip is configured to selectively pierce the target area 229 of the container wall 107 while the base is configured to increase the size of the opening in the container wall 107 to allow additive material to pass through the opening and around the shaft of the protrusion 207 that supports the conical puncture head 231.

Figure 3:
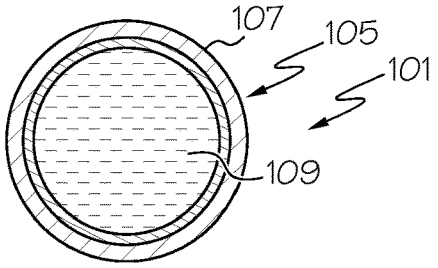
FIG. 3 illustrates a sectional view of the applicator apparatus along line 3-3 of FIG. 1.
Figure 4:
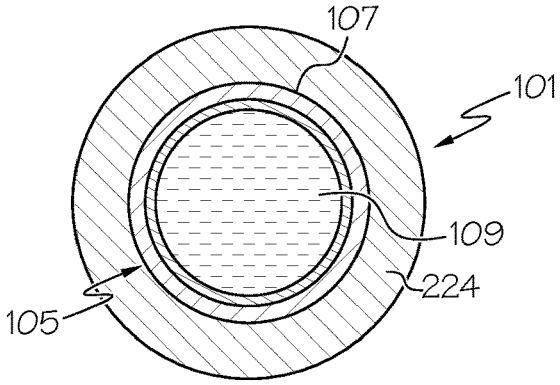
FIG. 4 illustrates a sectional view of the applicator apparatus along line 4-4 of FIG. 1.

As shown in FIGS. 2-4, the interior containment area 109 can contain an additive 111 that may be housed by the additive container 105 until it is desired to dispense the additive 111. The additive 111 can comprise liquids such as homogeneous mixture such as a solution of liquid or a heterogeneous mixture of a liquid and solid. In some embodiments, the additive can comprise a gel or liquid with relatively high viscosity or a liquid with relatively low viscosity. The additive 111 can comprise concentrates that may be later diluted by water or other liquid. In some examples, concentrates can comprise cleaning concentrates, perfumes, colorants, or other materials.

An interior surface of the container wall 107 may include a coating 227 to facilitate dispensing of the additive 111. For example, the coating 227 may comprise a hydrophobic material designed to repel the additive to allow efficient, such as complete dispensing of the additive 111 from the additive container 105.

Furthermore, as shown in FIG. 2, a second end portion 233 can include a second target area 235 that may be designed to be punctured during a dispensing operation. Optionally, a circumferential shroud 237 may be provided to define a reception area 239 to help guide the piercing device to pierce the container wall 107 at the second target area 235. As shown in FIG. 1, the additive container 105 may optionally include further features such as the illustrated tear line 113 to allow opening of the second end portion 233 at a predetermined location. Furthermore, the additive container 105 may optionally include a tear tab 115 designed to be pulled to tear an area 117 of the container wall 107 for dispensing the additive material. If provided, such tear tab 115 can be located at or close to the second target area 235 in some embodiments. In one particular embodiment, the second target area configuration may be replaced with the tear tab 115 such that optional opening of the second end portion 233 can be achieved without a puncturing implement.

Methods of assembling the applicator apparatus 101 will now be discussed. In some embodiments, the method can provide the applicator apparatus 101 with the circumferential wall 103 including the interior surface 201 defining the interior passage 202 extending along the axis 203 of the circumferential wall 103. The additive container 105 can be mounted to the first end portion 209 of the circumferential wall 103. The additive container 105 can include the container wall 107 defining the interior containment area 109 of the additive container 105. The container wall can include the target area 229 facing the interior passage 202. The circumferential wall 103 can further define the second end portion 213 that is opposite the first end portion 209 and defines the opening 211 into the interior passage 202. In some embodiments, portions of the applicator apparatus may be provided as a prefabricated applicator apparatus 101 with the additive container previously mounted to the first end portion 209 of the circumferential wall 103. Indeed, such prefabricated applicator apparatus may be purchased or provided as an off-the-shelf component.

As mentioned above, the circumferential wall 103 and additive container 105 may be provided as a prefabricated assembly. Alternatively, in further embodiments, step of providing the applicator apparatus 101 can include mounting the additive container to the first end portion of the circumferential wall 103. Indeed, in one embodiment, the second end portion 233 of the additive container 105 may be inserted through the opening 211, through the interior passage 202 and through an opening defined by the shoulder 224 at the first end portion 209 of the circumferential wall 103. The additive container 105 may be continued to be pulled through until the circumferential flange 223, acting as a stop, abuts the inner surface of the shoulder 224. Next, the example embodiment of assembling can include inserting the clamp ring 225 into the opening 211. The clamp ring 225 can then be engaged with the circumferential flange 223 to clamp the circumferential flange 223 between the clamp ring 225 and the shoulder 224 while the clamp ring 225 is press fit within the interior passage 202. In some embodiments, adhesive or other mounting technique may be applied to enhance the structural integrity of the connection between the circumferential flange 223 and the circumferential wall 103.

The method of assembling can further include inserting the support arm 205 through the opening 211 after the step of mounting the additive container to the first end portion of the circumferential wall 103 or after providing the prefabricated circumferential wall 103 that is already mounted to the additive container 105. Indeed, the support arm 205 can be inserted through the opening 211 and then into the interior passage 202 with the protrusion 207 of the support arm 205 extending in the axial direction 219 of the axis 203 toward the target area 229. Once inserted, a plurality of the ends 215*a-d* of the support arm 205 may be movably engaged with the interior surface 201 at a respective location. For instance, by way of illustration, the first end 215*a* of the support arm 205 can be movably engaged with the interior surface 201 at the first location 204*a* and the second end 215*b* of the support arm 205 can be movably engaged with the interior surface 201 at the second location 204*b* spaced from the first location 204*a*. Optionally, the third end 215*c* of the support arm 205 can be movably engaged with the interior surface 201 at the third location 204*c* spaced from the first location 204*a* and the second location 204*b*. Furthermore, optionally the fourth end 215*d* of the support arm 205 can be movably engaged with the interior surface 201 at the fourth location 204*d* spaced from the first, second and third locations 204*a-c*. In some embodiments, the step of inserting the support arm 205 includes press fitting the support arm 205 within the interior passage 202 as discussed previously. In further examples, the step of inserting the support arm 205 includes sliding each of the ends 215*a-d* of the support arm 205 against the interior surface 201.

Methods of introducing an additive to a liquid container will now be discussed. Throughout the disclosure, a liquid container includes a wall defining an interior containment area designed to contain liquid. The liquid containers throughout the disclosure further include an opening defined by a mouth of the container. The mouth of any of the liquid containers may include threads (e.g., exterior threads) to facilitate mounting of a cap, dispenser (e.g., spray nozzle) or other device to the mouth. The opening is designed to provide access to the interior containment area, for example, to insert additive, diluting liquid or other solids or liquids into the interior containment area. A wide variety of liquid containers may be provided such as containers designed to contain cleaning liquids, perfumes, or edible liquids. By way of illustration, the containers throughout the disclosure comprise a liquid container 601 comprising a spray bottle container designed to spray cleaning solution although any variety of containers may be provided in accordance with aspects of the disclosure.

Figure 6:
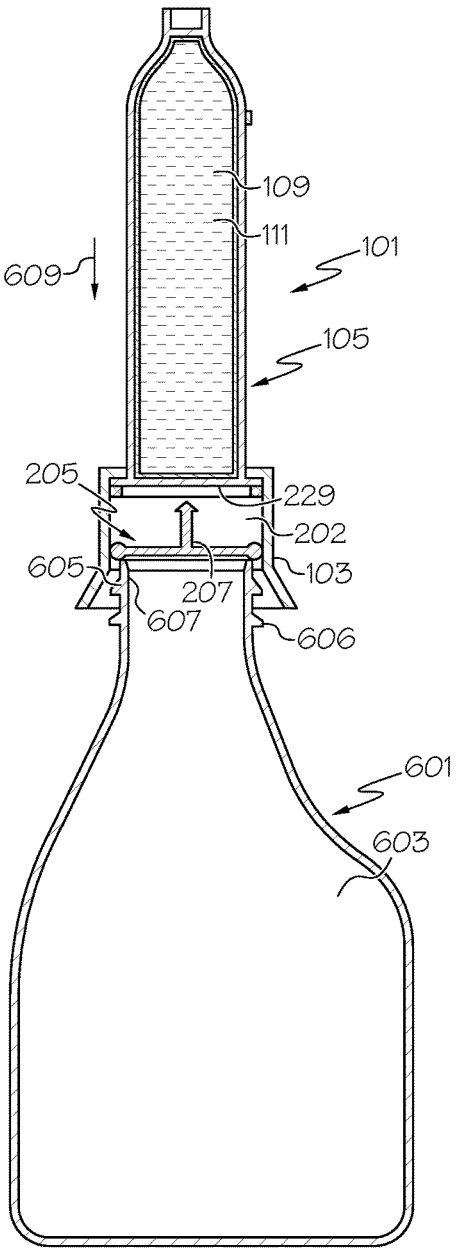
FIGS. 6-8 illustrate example steps of adding additive into an interior containment area of a container with an applicator apparatus.
Figure 7:
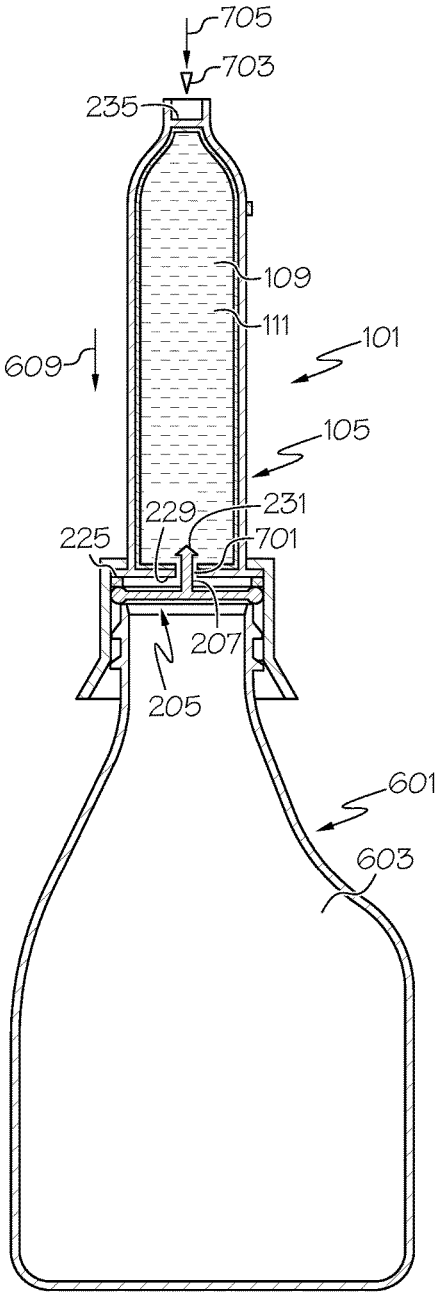
Figure 8:
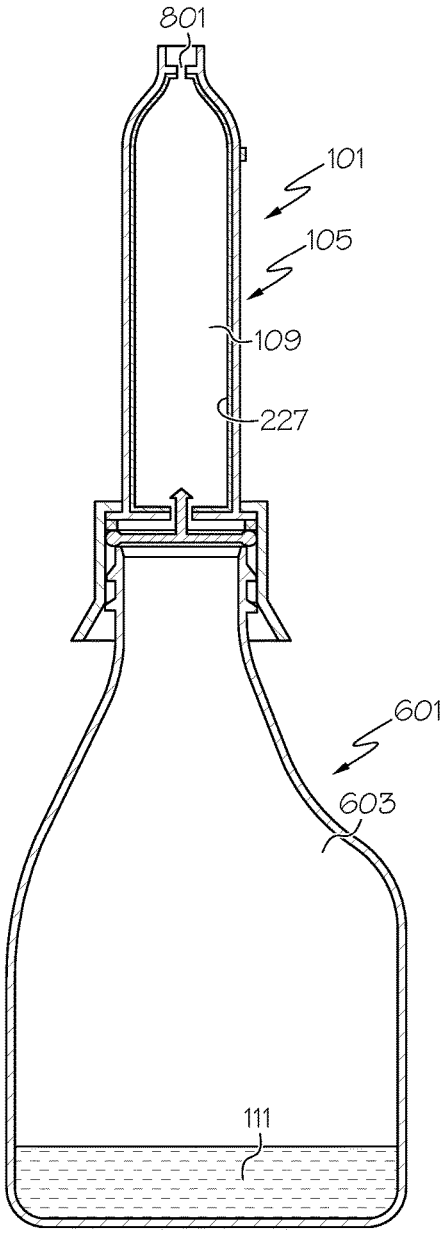

With initial reference to FIGS. 6-8, the method can include introducing the additive 111 into an interior containment area 603 defined by the liquid container 601. As shown in FIGS. 6-7, the interior containment area 603 can be initially empty although liquid or other materials may be present in further examples. The method can include positioning a mouth 605 of the liquid container 601 into the interior passage 202 defined by the circumferential wall 103 of the applicator apparatus 101. As shown in FIG. 6-8, the additive container attached to the circumferential wall 103 is placed at a dispensing position relative to an opening 607 defined by the mouth 605 of the liquid container 601. The method can further include driving the protrusion 207 relative to the additive container 105 to pierce the target area 229 of the container wall 107 of the additive container 105 such that the additive 111 (e.g., liquid additive) drains from the interior containment area 109 of the additive container 105, through the opening 607 of the mouth 605 and then into the interior containment area 603 of the liquid container 601. In one example, the liquid container 601 may rest on a support surface (e.g., counter or table surface) while the additive container 105 is shifted downward in direction 609 (e.g., a direction of gravity) relative to the liquid container 601.

Although not required in all embodiments, some embodiments may include including movably mounting a support arm 205 relative to the circumferential wall 103. For instance, as shown in FIG. 6, the upper edge of the mouth 605 engages the support arm 205 as the additive container 105 is shifted downward in the direction 609. As shown in FIGS. 6 and 7, the mouth 605 of the liquid container 601 can drive the support arm 205 relative to the additive container 105 to pierce the target area 229 with the protrusion 207. Indeed, in one embodiment while the liquid container 601 rests on a support surface, the additive container 105 may be shifted downward in direction 609 to drive the protrusion 207 to move relative to the additive container 105 toward the target area 229 to pierce the target area as shown in FIG. 7. As shown in FIG. 7, the support arm 205 may be driven until the support arm 205 hits a stop (e.g., the clamp ring 225 in the illustrated example), wherein the conical puncture head 231 can be positioned within the interior containment area 109 of the additive container 105. The puncture head 231 can tear a relatively large opening 701 that is larger than the diameter of the shaft supporting the conical puncture head 231 and positioned within the opening 701. Consequently fluid may drop by the force of gravity through the opening 701 and around the shaft of the protrusion 207 and into the interior containment area 603 of the liquid container 601 as shown in FIG. 8. Optionally, in examples where the additive container wall 107 is collapsible, the container wall 107 can be squeezed to collapse the additive container 105 to quickly dispense the additive 111 into the liquid container 601. Optionally, as shown in FIG. 7, an implement 703 (e.g., knife, needle or other relatively sharp implement) may be inserted in direction 705 to puncture the second target area 235 to provide an air hole 801 (see FIG. 8). As such, air may enter into the air hole 801 as the additive drains from the opening 701 to further facilitate dispensing of the additive 111 from the additive container 105. In addition, as shown in FIG. 8, the coating 227 (e.g., hydrophobic coating) can further facilitate efficient dispensing of the additive 111 into the interior containment area 603 of the liquid container 601.

Figure 9:
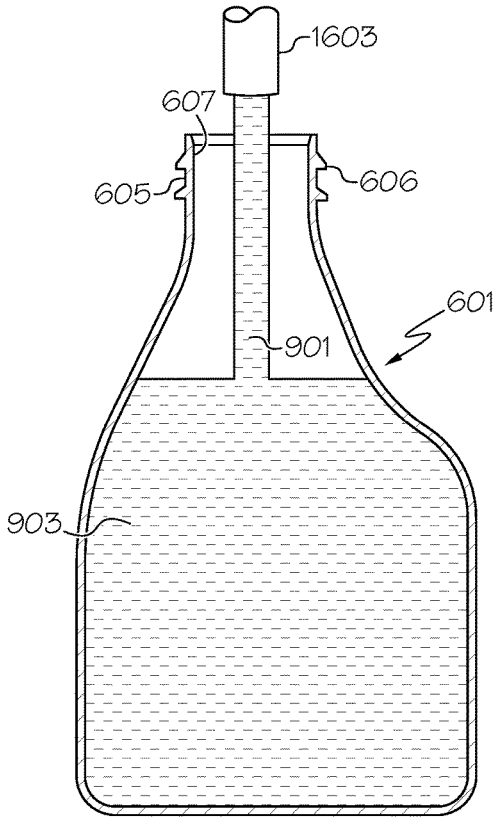
FIG. 9 illustrates adding liquid, such as water, to a container to dilute the additive into a mixture.

In one embodiment, as shown in FIG. 9, after the additive is dispensed into the interior containment area 603 of the container, liquid, such as water 901, may also be introduced by a source liquid such as a nozzle 1603 (e.g., a water faucet nozzle) into the interior containment area 603 through the opening 607 of the mouth 605 of the liquid container 601. The additional liquid can dilute the additive to provide a mixture 903 with the appropriate ratio of additive to water 901 (or other liquid). Adding the additional liquid after adding the additive can be beneficial to provide mixing of the additive 111 with the water 901 due to the currents produced during the filling process. Although not shown, in any of the embodiments of the disclosure, the water 901 or other liquid may be added first and then the additive material may be added after an appropriate amount of water 901 is provided. Such examples may be desired to avoid foaming or other bubbles that may generate due to the nature of the additive 111 mixing with the water 901 or other liquid.

Figure 10:
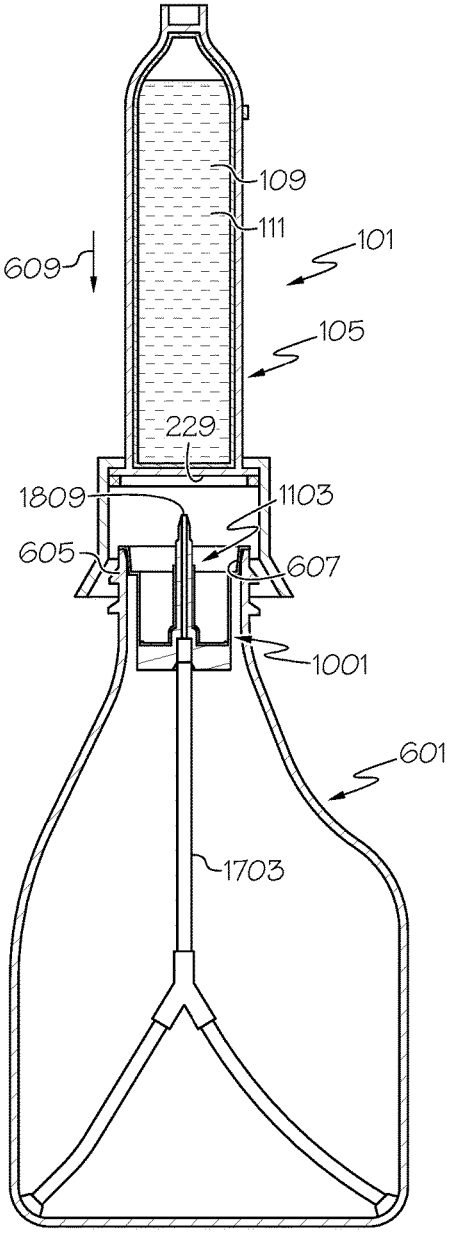
FIGS. 10-12 illustrate further example steps of adding additive into an interior of the containment area of a container with an applicator apparatus.
Figure 11:
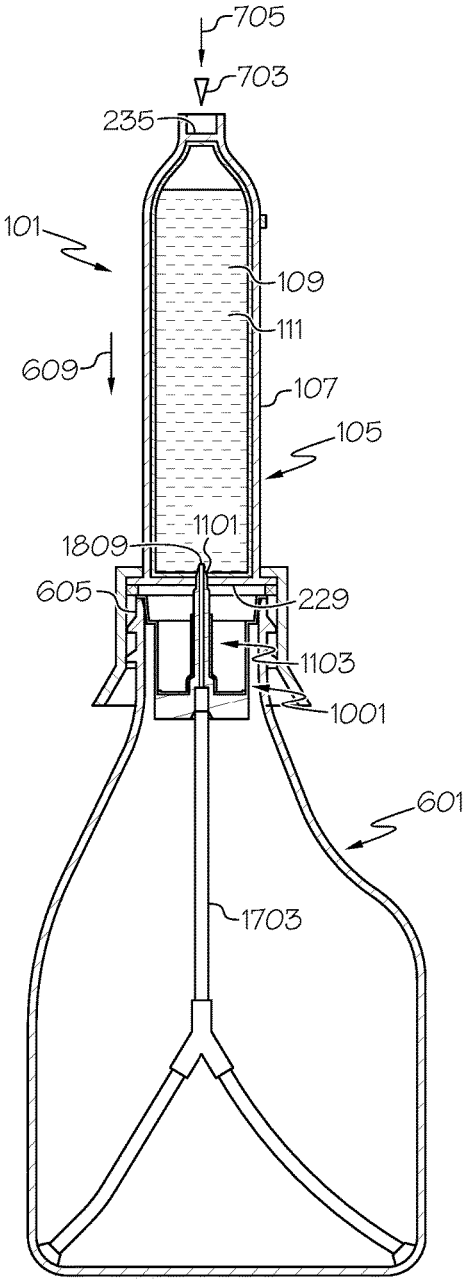
Figure 12:
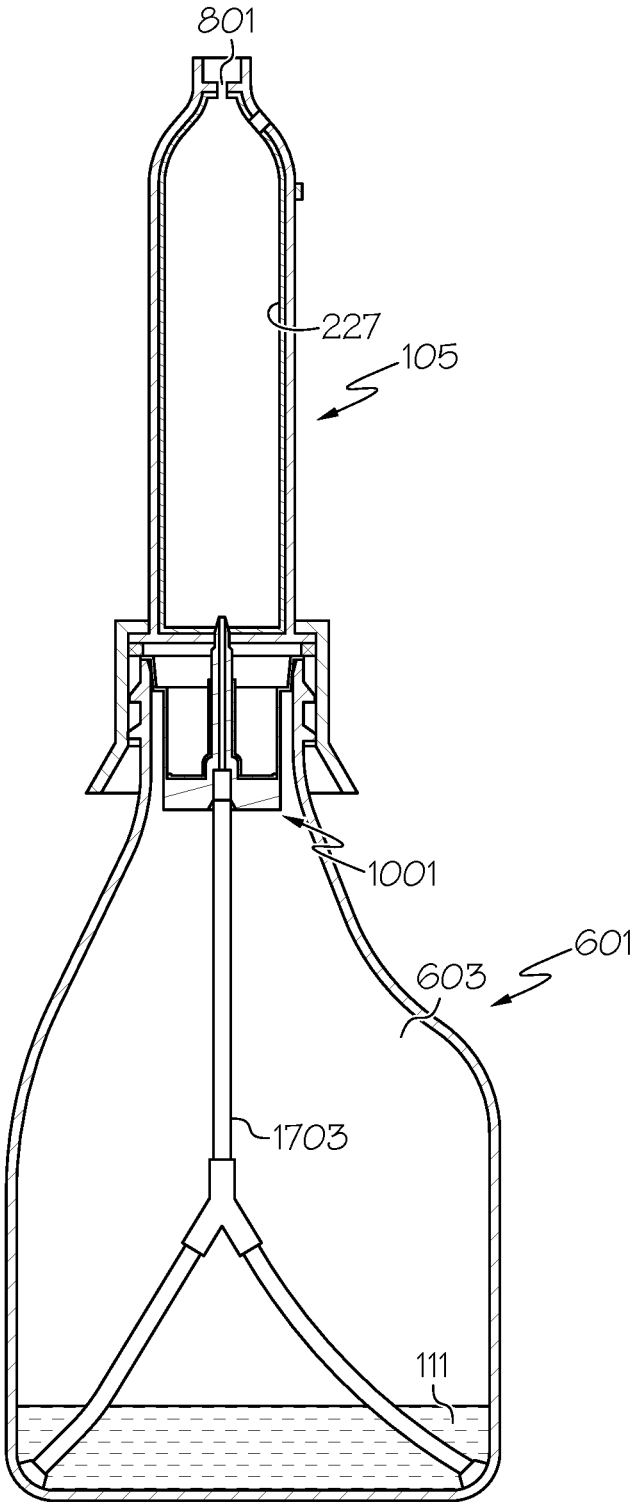

In some embodiments, the applicator apparatus 101 may be provided without the support arm 205. For instance, in some embodiments, the protrusion can be fixedly mounted with respect to the mouth 605 of the liquid container 601. For instance, as shown in FIGS. 10-12 a mouth fill device 1001 may be fixedly mounted to the mouth 605 of the liquid container such that a protrusion 1103 is likewise fixedly mounted with respect to the mouth 605 of the liquid container 601. In such examples, driving the protrusion 1103 can include axially moving the additive container relative to the liquid container 601 (e.g., in direction 609) such that protrusion 1103 pierces the target area 229 to create an opening 1101 while the protrusion 1103 remains fixedly mounted with respect to the mouth 605. Optionally, in examples where the additive container wall 107 is collapsible, the container wall 107 can be squeezed to collapse the additive container 105 to quickly dispense the additive 111 into the liquid container 601. Optionally, as shown in FIG. 11, the implement 703 (e.g., knife, needle or other relatively sharp implement) may be inserted in direction 705 to puncture the second target area 235 to provide an air hole 801 (see FIG. 12). As such, air may enter into the air hole 801 as the additive drains from the opening 1101 to further facilitate dispensing of the additive 111 from the additive container 105. In addition, as shown in FIG. 12, the coating 227 (e.g., hydrophobic coating) can further facilitate efficient dispensing of the additive 111 into the interior containment area 603 of the liquid container 601.

Figure 13:
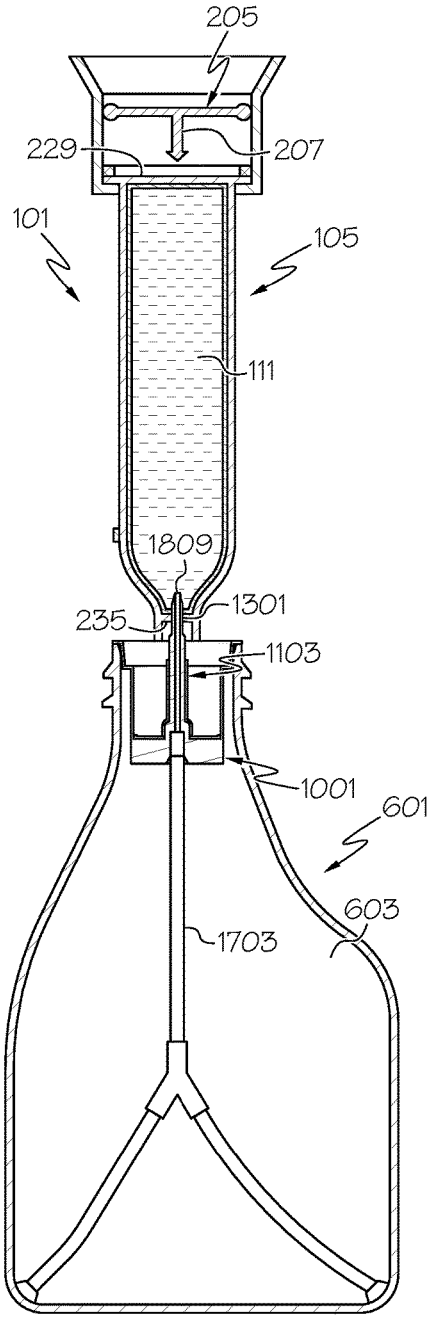
FIGS. 13-15 illustrate further example steps of adding additive into an interior of the containment area of a container with an applicator apparatus.
Figure 14:
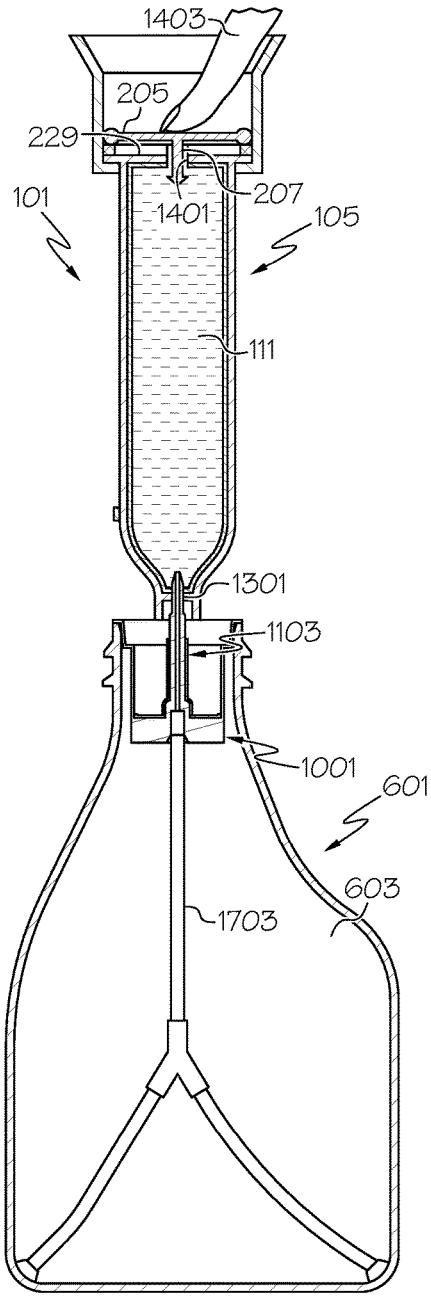
Figure 15:
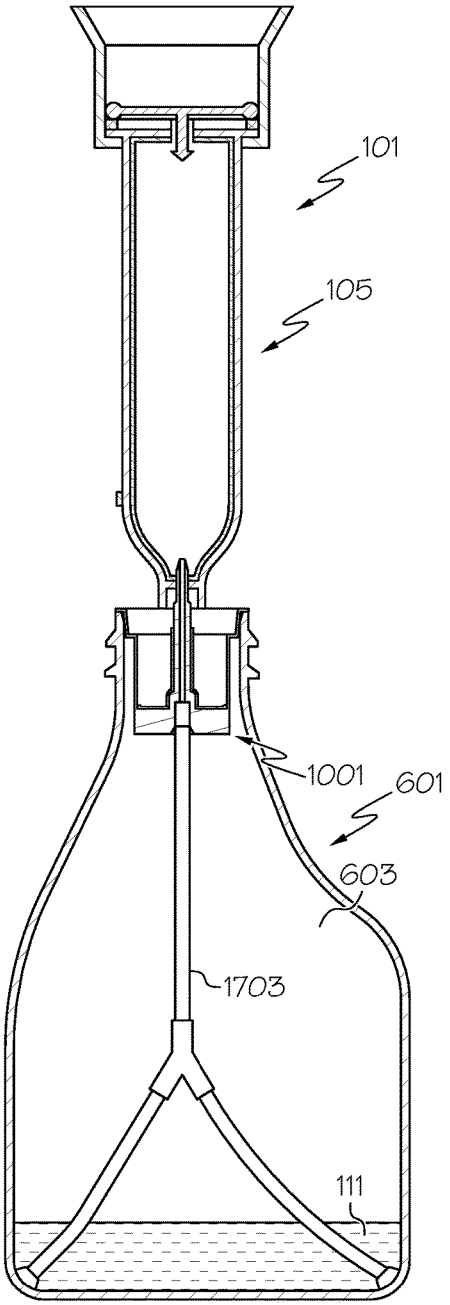

Features of the disclosure can further include inserting an applicator and thereafter dispensing additive into the interior containment area of a container. Features of the disclosure may be used, for example, with additive applicators disclosed in U.S. patent application Ser. No. 15/055,471 filed Feb. 26, 2016 and titled "Spray nozzle with Refill Valve", published as US Patent Application Publication No. US2016/0256882 on Sep. 8, 2016, that is herein incorporated by reference in its entirety. FIGS. 13-14 illustrate a further example of dispensing the additive 111 into the interior containment area 603 of the liquid container 601. In this embodiment, an additive container 105 is inverted from the orientation shown in the embodiment of FIGS. 10-12. In this embodiment, the protrusion 1103 of the mouth fill device 1001 may be used to pierce the second target area 235. In such examples, driving the protrusion 1103 can include axially moving the additive container relative to the liquid container 601 such that protrusion 1103 pierces the second target area 235 to create an opening 1301 while the protrusion 1103 remains fixedly mounted with respect to the mouth 605. Optionally, in examples where the additive container wall 107 is collapsible, the container wall 107 can be squeezed to collapse the additive container 105 to quickly dispense the additive 111 into the liquid container 601. Optionally, the opposed target area may be pieced with an implement (e.g., knife, needle or other relatively sharp implement) to provide an air hole 1401. In the illustrated embodiment, the support arm 205 may be pressed by an individual's finger 1403 or other pushing device to drive the protrusion 207 to pierce the target area 229 in a manner discussed previously with respect to FIGS. 6-8. As such, air may enter into the air hole 1401 as the additive drains from the opening 1301 to further facilitate dispensing of the additive 111 from the additive container 105 and into the interior containment area 603 as shown in FIG. 15.

FIGS. 18-21 illustrate features of the mouth fill device 1001 with the understanding that more or less features may be provided depending on the function to be performed by the mouth fill device 1001 and/or the particular application of the mouth fill device 1001. Indeed, the mouth fill device 1001 shown in FIGS. 18-21 can be identical to the mouth fill device 1001 previously described with respect to FIGS. 10-15 and further described with respect to FIGS. 16-17, 30, 31, 37 and 38 below although the mouth fill device may be provided with more or less features than illustrated in the mouth fill device shown in FIGS. 18-21. Furthermore, alternative examples of mouth fill devices may be provided in further examples. For instance, FIGS. 22-25 illustrates another embodiment of a mouth fill device 2201 and FIGS. 26-29 illustrate still another embodiment of a mouth fill device 2601 that may be incorporated in accordance with features of the disclosure.

In some embodiments, each mouth fill device 1001, 2201, 2601 can be mounted with respect to the mouth 605 of the liquid container 601. As shown in FIGS. 18, 19, 22, 23, 26 and 27, each mouth fill device 1001, 2201, 2601 can include a circumferential shroud 1801 circumscribing an axis 1803 of the mouth fill device 1001, 2201, 2601. As shown, the axis 1803 can comprise a central axis (e.g., a symmetrical central axis) of the mouth fill device 1001, 2201, 2601 although further embodiments may provide the axis 1803 as an offset axis (e.g., a symmetrical offset axis) that is offset from the central axis of the mouth fill device 1001, 2201, 2601. As shown in FIGS. 19-21, 23-25 and 27-29, the shroud 1801 can include an inner surface 1901 defining an interior passage 1903 extending along the axis 1803. As further illustrated, the inner surface 1901 can include a circular profile along a section taken perpendicular to the axis 1803 although other shapes such as other curvilinear profiles (e.g., oblong, oval) or polygonal profiles (e.g., triangular, rectangular) may be provided in further embodiments. Furthermore, as shown, the cross sectional profile of the inner surface 1901 along the section taken perpendicular to the axis 1803 can be substantially the same along a length 1805 of the shroud 1801. In the illustrated example, the inner surface 1901 may comprise a circular cylindrical inner surface with the same diameter throughout the length 1805 of the shroud 1801. In some examples, the inner surface 1901 may be slightly flared or tapered in a direction 1804 of the axis 1803. However, there may be a desire to limit the extent of tapering of the inner surface 1901 in the direction 1804 to avoid interfering with a liquid flow through the interior passage 1903. Furthermore, there may be a desire to limit a flaring of the inner surface 1901 in the direction 1804 to avoid an oversized end portion that prove difficult to insert into the opening 607 of the liquid container 601.

In some examples, each mouth fill device 1001, 2201, 2601 can also include a circumferential lip 1807 circumscribing an end 1906 of the circumferential shroud 1801 and extending radially away from the axis 1803. Referring to FIGS. 20, 21, 24, 25, 28 and 29, the circumferential lip 1807 can include a plurality of apertures 2001 disposed about the axis 1803 that extend entirely through the circumferential lip 1807 between opposed surfaces of the circumferential lip 1807. The each aperture of the plurality of apertures 2001 can be disposed in series relative to one another such that one of the plurality of apertures 2001 is disposed between another pair of apertures of the plurality of apertures 2001. Although not shown, other patterns may be provided in further embodiments. Furthermore as shown, the apertures can comprise an oval shape although an oblong, circular or other curvilinear shape may be provided in further examples. Still further, the apertures may comprise a triangular, rectangular or other rectilinear shape in further examples. The apertures are configured to release gas from the interior containment area 603 of the liquid container 601 when adding liquid to the container. As shown, the circumferential lip 1807 extends at a 90° angle relative to the wall of the circumferential shroud 1801 although other angles may be provided in further examples. In some embodiments, it may be a desire to orient the circumferential lip at a 90° angle relative to the wall of the circumferential shroud 1801 to avoid interference of gas streams emitting from the apertures from interrupting the flow of liquid in the container and/or to avoid restriction of gas streams emitting from the apertures due to an interference with the flow of liquid in the container or upper portions of the mouth fill device or mouth of the fluid container.

Figure 18:
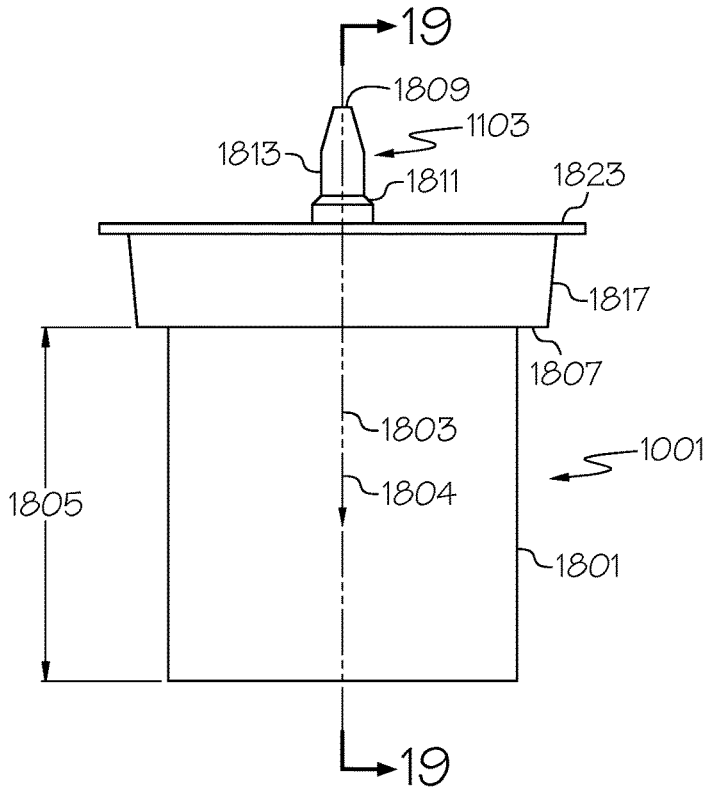
FIG. 18 illustrates a side view of an embodiment of a mouth fill device including features of the disclosure.
Figure 19:
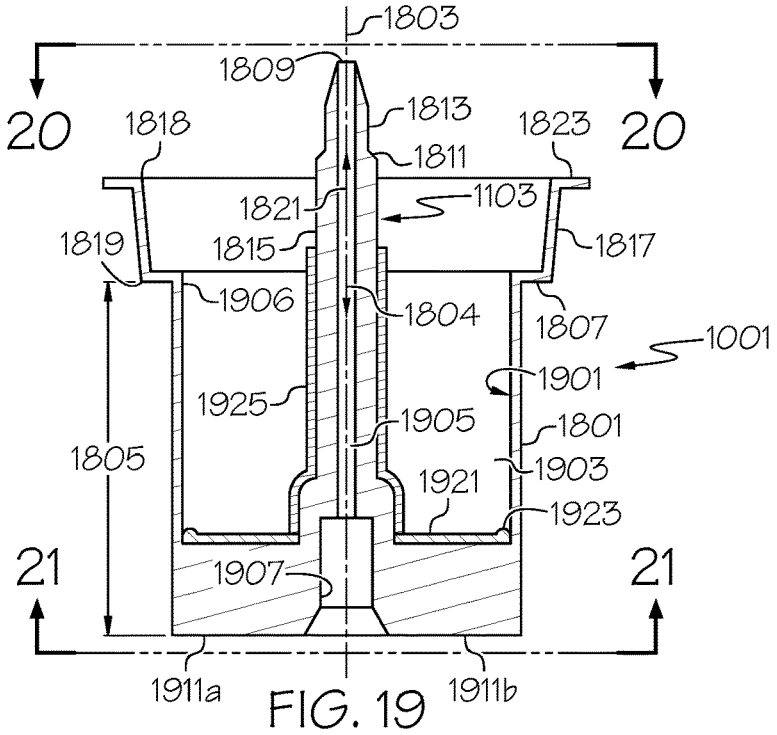
FIG. 19 illustrates a sectional view of the mouth fill device along line 19-19 of FIG. 18.
Figure 20:
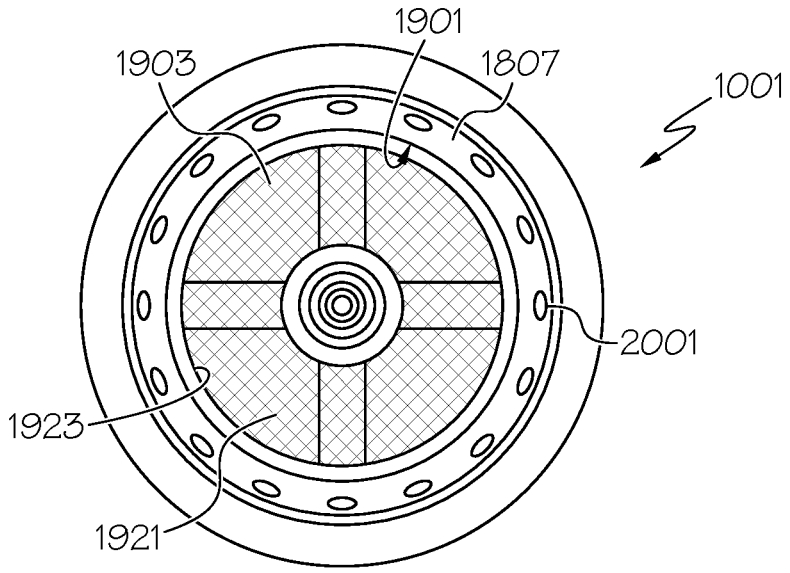
FIG. 20 illustrates a top view of the mouth fill device along line 20-20 of FIG. 19.
Figure 21:
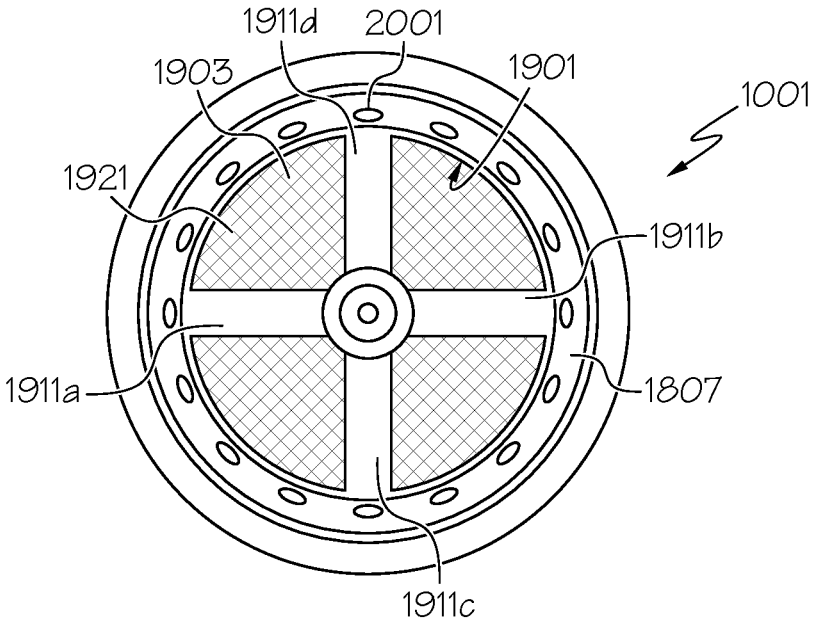
FIG. 21 illustrates a bottom view of the mouth fill device along line 21-21 of FIG. 19.
Figure 22:
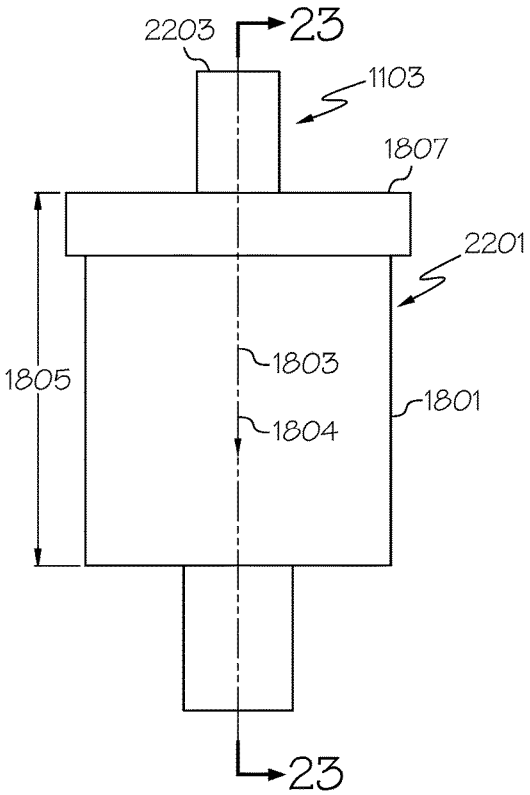
FIG. 22 illustrates a side view of another embodiment of a mouth fill device including features of the disclosure.
Figure 23:
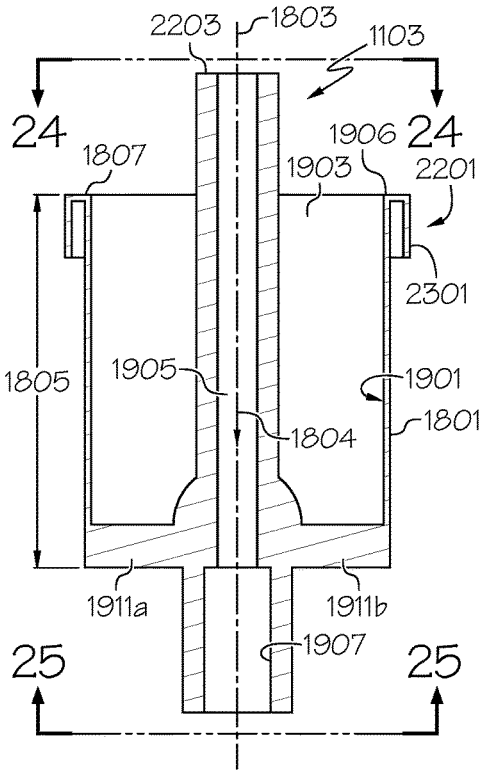
FIG. 23 illustrates a sectional view of the mouth fill device along line 23-23 of FIG. 22.
Figure 24:
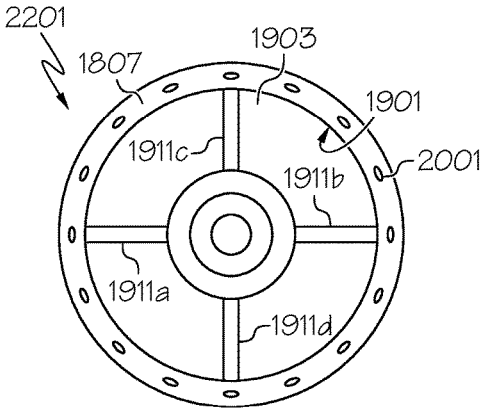
FIG. 24 illustrates a top view of the mouth fill device along line 24-24 of FIG. 23.
Figure 25:
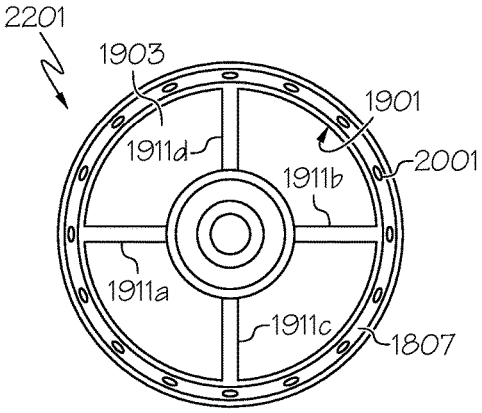
FIG. 25 illustrates a bottom view of the mouth fill device along line 25-25 of FIG. 23.
Figure 26:
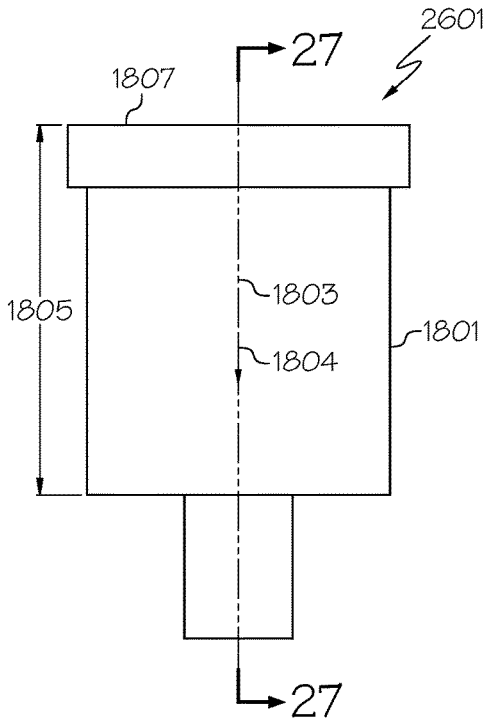
FIG. 26 illustrates a side view of still another embodiment of a mouth fill device including features of the disclosure.

In some examples, the mouth fill device can also include a protrusion mounted relative to the circumferential shroud and extending within the interior passage. For example, with reference to FIGS. 19 and 23, the mouth fill device 1001 and 2201 can include the protrusion 1103 mounted relative to the circumferential shroud 1801 and extending within the interior passage 1903. Referring to FIGS. 18 and 19, in some examples, the protrusion 1103 can include a relatively sharp piercing tip 1809 configured to pierce a target area of an additive container as described with respect to FIGS. 10-12 and 13-15 above. FIGS. 22-23 illustrate the protrusion 1103 including a relatively blunted tip 2203 that can still act as a piercing tip in some embodiments. Indeed, significant pressure may need to be applied with the blunted tip 2203 but piercing may result in a rupturing of the target area, thereby increasing the rate that the additive 111 is emptied from the additive container 105. In contrast, the relatively share piercing tip 1809 can reduce the effort necessary to pierce the target area while still providing a satisfactory flow rate of additive 111 from the additive container 105 to the liquid container 601.

In further embodiments, the protrusion 1103 if provided, can function to help deliver fluid from the liquid container 601 to a liquid dispensing device. Various liquid dispensing devices may be provided such as spray nozzle 1701 illustrated in FIG. 17. In any of the embodiments of the disclosure, the mouth 605 of the liquid container may optionally comprise threads, such as the illustrated exterior threads 606 that may engage interior threads 1714 of the threaded coupler 1713 to firmly attach the spray nozzle 1701. Indeed, in some embodiments the protrusion 1103 can include an interior passageway 1905, wherein a liquid dispensing path of the liquid container is defined by the interior passageway of the protrusion and an interior channel of a dip tube 1703 extending into the interior containment area 603 of the liquid container 601. In some examples, the dip tube 1703 can comprise a branched dip tube including two or more lower ends 1705*a*, 1705*b* configured to dispense mixed liquid 903 from the liquid container 601. In some embodiments, the dip tubes may be designed in accordance with U.S. patent application Ser. No. 14/323,873 filed on Jul. 3, 2014, and published as U.S. Patent Application Publication No. US2016/0001312, the entire application which is incorporated herein by reference in its entirety. Alternatively, although not shown, any of the embodiments of the disclosure can have a single dip tube that is not split into two end tubes. Rather, the single tip tube may include a single end disposed near or at the bottom of the liquid container.

Figure 17:
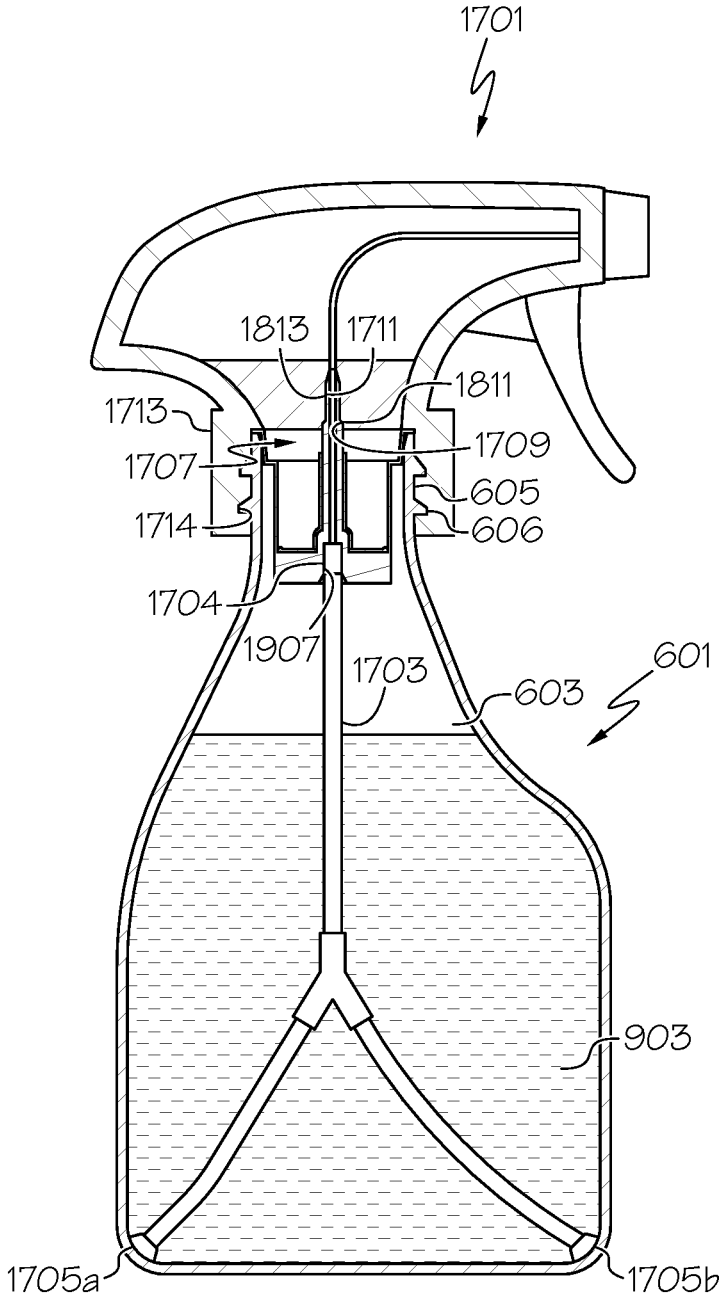
FIG. 17 illustrates applying a spray nozzle to the opening of the liquid container of FIG. 16.

In some embodiments, the protrusion 1103 may include a configuration designed to mate with a socket within the liquid dispensing device. For instance, as shown in FIGS. 18-19, the protrusion 1103 can include an interface surface 1811. As shown, in some examples the interface surface 1811 can include a frustoconical surface that flares outwardly in the direction 1804 of the axis 1803 from a first diameter of a first protrusion segment 1813 to a second diameter of a second protrusion segment 1815. Such, as shown in FIG. 17, an interface connection 1707 may exist between the interface surface 1811 of the protrusion 1103 and a complementary interface surface 1709 of the spray nozzle 1701. In the illustrated embodiment, the interface surface 1811 of the protrusion 1103 can include the frustoconical surface that is designed to be received by a corresponding frustoconical surface 1709 of the spray nozzle 1701. When installing, the first protrusion segment 1813 of the protrusion 1103 may be inserted in a channel 1711 of the spray nozzle. A threaded coupler 1713 of the spray nozzle 1701 may then be tightened such that interior threads 1714 of the threaded coupler 1713 engage exterior threads 606 of the mouth 605. Tightening of the threaded coupler 1713 may continue wherein the interface surface 1811 of the protrusion 1103 mates with the interface surface 1709 of the spray nozzle 1701. The interface surface 1811 of the protrusion 1103 can act as a stop against the interface surface 1709 of the spray nozzle 1701. Furthermore in embodiments with the illustrated frustoconical interface surfaces, tightening of the threaded coupler 1713 can cause the frustoconical interface surface 1811 of the protrusion 1103 to wedge against the frustoconical interface surface 1709 of the spray nozzle to provide a fluid tight connection between the interior passageway 1905 of the protrusion 1103 and the spray nozzle 1701.

Figure 16:
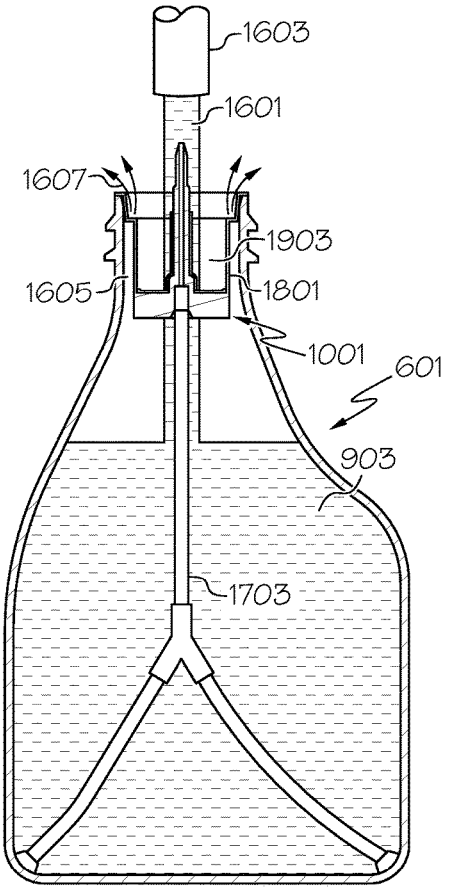
FIG. 16 illustrates adding liquid, such as water, to a container to dilute the additive into a mixture.
Figure 27:
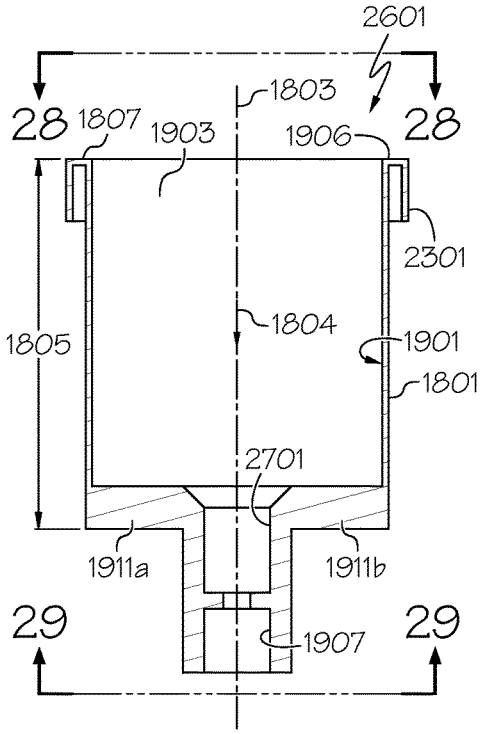
FIG. 27 illustrates a sectional view of the mouth fill device along line 27-27 of FIG. 26.

In further embodiments, as shown in FIGS. 19, 23, and 27, each mouth fill device 1001, 2201, 2601 can include a dip tube port 1907 mounted relative to the circumferential shroud 1801. The dip tube port allows the mouth fill device support the dip tube 1703 relative to the mouth 605. Specifically, as shown in FIG. 17, the above-referenced dip tube 1703 can include an end 1704 that may be mounted (e.g., by way of press fit) within the dip tube port 1907. Optionally, as shown in FIG. 19, the dip tube port 1907 may be located within the interior passage 1903 to provide a compact mouth fill device 1001. Alternatively, the dip tube port 1907 may optionally be located outside of the interior passage 1903 as illustrated in FIGS. 23 and 27. The dip tube port, if provided can allow removal of the spray nozzle 1701 without requiring removal of the dip tube. Consequently, refilling the liquid container 601 can be simplified and more consumer friendly since removal of the dip tube will not be required that may otherwise undesirably drip residual fluid from the dip tube to the surrounding environment. Indeed, as shown in FIG. 16, the dip tube can remain within the bottle even when the spray nozzle 1701 is not associated with the liquid container 601. Once the liquid container is refilled, the spray nozzle 1701 may be conveniently interfaced with the mouth fill device 1001 mounted to the mouth 605 of the liquid container 601.

Figure 28:
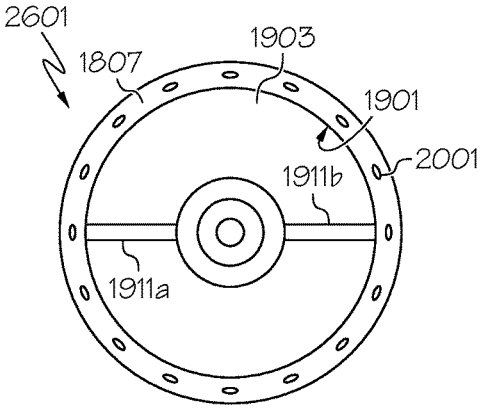
FIG. 28 illustrates a top view of the mouth fill device along line 28-28 of FIG. 27.
Figure 29:
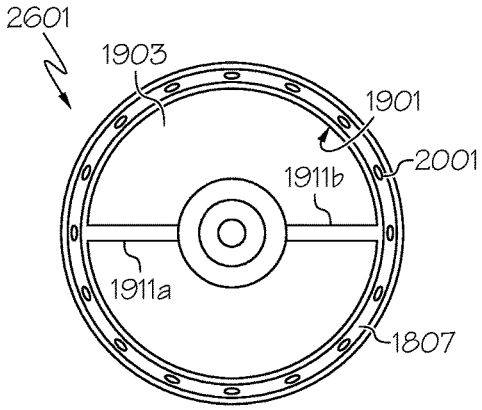
FIG. 29 illustrates a bottom view of the mouth fill device along line 29-29 of FIG. 27.

In some embodiments, the mouth fill device 1001, 2201, 2601 includes at least one support arm 1911*a-d* including one end connected relative to the dip tube port 1907 and/or the protrusion 1103 another end connected relative to the circumferential shroud 1801. In some embodiments, although not shown, only one support arm may be necessary to support the dip tube port 1907 and/or the protrusion 1103 although two or more support arms may be provide in further examples. For instance, as shown in FIGS. 27-29, a plurality of support arms are provided to support the dip tube port 1907 relative to the circumferential shroud 1801. Indeed, as shown FIG. 27, a first support arm 1911*a* and a second support arm 1911*b* each include a first end connected indirectly to the dip tube port 1907 by way of another port 2701 designed to receive an interface tube from another example of a spray nozzle (not shown). As further shown in FIG. 27, the first support arm 1911*a* and the second support arm 1911*b* can each include a second end mounted to an end portion of the circumferential shroud 1801. In further examples, three or more support arms may be provided to support the dip tube port 1907 and/or the protrusion 1103. For example, as shown in FIGS. 19-21 and 23-25, the plurality of support arms can include four support arms 1911*a-d* that each include a first end portion connected to both the dip tube port 1907 and the protrusion 1103 and a second end portion connected to the circumferential shroud 1801.

As further illustrated in FIGS. 19 and 23, the protrusion 1103 can be mounted relative to the circumferential shroud and extending within the interior passage 1903. Extending within the interior passage can provide a compact mouth fill device. Furthermore, as shown, the axis 1803 (e.g., central symmetrical axis) of the mouth fill device 1001, 2201, 2601 can extend through the protrusion 1103 such as a central axis (e.g., central symmetrical axis) of the protrusion 1103. Providing the axis 1803 as a central axis extending through the protrusion 1103 can help the mouth fill device cooperate with a conventional spray nozzle that typically includes a port for the dip tube at the center of the opening 607 of the mouth 605 of the liquid container 601. In alternative embodiments, although not shown, the axis 1803 can comprise an offset axis that is offset from the central axis of the mouth fill device 1001, 2201, 2601. Providing the axis 1803 as an offset axis extending through the protrusion 1103 can help the mouth fill device cooperate with another conventional spray nozzle that may include a port for the dip tube at an offset location of the opening 607 of the mouth 605 of the liquid container 601.

Any one of the mouth fill devices 1001, 2201, 2601 may be mounted with respect to the mouth 605 of the liquid container 601. As shown in FIGS. 23 and 27, a circumferential mounting flange 2301 may be provided that can comprise a circular cross-sectional profile along a section taken perpendicular to the axis 1803. In some embodiments, the outer diameter of the circumferential shroud 1801 can be slightly greater than the expected inner diameter of the opening 607 of the mouth 605. Once mounted, the outer circumferential shroud 1801 may be press fit within the opening 607 of the mouth 605 to fixedly attach the mouth fill device 2201, 2601 to the mouth 605 of the liquid container 601.

In another embodiment, with reference to FIG. 10, the mouth fill device 1001 is also shown fixedly mounted relative to the mouth 605 of the liquid container 601. As shown in FIG. 18-19, the mouth fill device 1001 can include a frustoconical flange 1817 extending from an outer periphery 1819 of the circumferential lip 1807 in a direction 1821 along the axis 1803 extending away from the circumferential shroud 1801. Furthermore, a peripheral flange 1823 can extend outwardly from a peripheral end 1818 of the frustoconical flange 1817 in a direction extending radially away from the axis 1803 of the shroud 1801. Indeed, in some embodiments, as shown, the peripheral flange 1823 can extend outwardly from the peripheral end 1818 in a direction that is perpendicular to the axis 1803 while extending radially away from the axis 1803.

To fixedly attach the mouth fill device 1001 to the mouth 605 an end of the mouth fill device 1001 is inserted into the opening 607 of the mouth 605. The mouth fill device 1001 can then be axially further inserted in an axial direction of an axis of the opening 607 until the frustoconical flange 1817 engages the mouth 605. In the illustrated embodiment, the axis of the opening 607 comprises a symmetrical central axis of the opening 607. Although not shown, the axis of the opening 607 may comprise an offset axis (e.g., symmetrical offset axis) or a central axis that is not a symmetrical central axis. The frustoconical nature of the frustoconical flange 1817 accommodates for dimensional differences between openings and can therefore adapt to a wide range of opening diameters, such as openings having diameters within an acceptable tolerance range. Further insertion of the mouth fill device 1001 can result in the frustoconical flange 1817 being compressed against the interior surface of the opening 607 that can partially or entirely straighten a portion or the entire frustoconical flange 1817 into a substantially straight segment to provide a fluid tight seal between the outer surface of the frustoconical flange 1817 and the inner surface of the opening 607. Further insertion can continue until the peripheral flange 1823 engaged the top edge of the mouth 605, wherein the peripheral flange 1823 may act as a stop to limit the extent that the mouth fill device 1001 is inserted into the opening 607.

Once mounted, the mouth fill device 1001, 2201, 2601 can be conveniently fixed relative to the mouth 605 of the liquid container 601, thereby assisting with a wide range of functions. For instance, the protrusion 1103, if provided, can assist with piercing the target area 229, 235 of the container wall 107 of the additive container 105 discussed above. Once pierced, the additive 111 can drain through the interior passage 1903 and through the areas between the one or more support arms 1911*a-d* and into the interior containment area 603 of the liquid container 601.

Furthermore, the protrusion 1103, if provided, can include the interior passageway 1905 that may communicate, by way of the dip tube port 1907 with an interior passage of the dip tube 1703. In such a manner, dip tube 1703 can interface with the spray nozzle 1701 by way of the mouth fill device 1001, 2201, 2601 that may be mounted to the mouth 605 of the liquid container 601. As such, the spray nozzle 1701 may be easily and quickly removed and replaced without removing the dip tube 1703 from the interior containment area 603 of the liquid container 601.

Furthermore, the mouth fill device 1001, 2201, 2601 can also facilitate filling of the liquid container 601 with liquid. Indeed, as shown in FIG. 16, liquid 1601 from a nozzle 1603 (e.g., a water faucet nozzle) or other source may travel through the interior passage 1903 of the mouth fill device, through the open areas between the support arms 1911*a-d* and into the interior containment area 603 of the liquid container 601. As shown in FIG. 16, an area 1605 between the circumferential shroud 1801 and the interior surface of the wall of the liquid container 601 can allow displaced air within the interior containment area 603 due to filling with the liquid 1601 to pass through the apertures 2001 as gas streams 1607. As such, air is freely allowed to exit the interior containment area 603 of the liquid container 601 without the possibility of being blocked by the liquid 1601, thereby preventing interruptions in liquid flow through the opening of the container that may result in fluid spilling rather than entering the liquid container.

Referring to FIG. 19, in some embodiments, any of the mouth fill devices 1001, 2201, 2601 can include a filter 1921. The filter 1921 may include a central opening optionally mounted to a sleeve 1925 and an outer periphery optionally mounted to a seal 1923 to seal against the inner surface 1901 of the circumferential shroud 1801. In some embodiments, the seal 1923, if provided, can include an O-ring seal, rubber seal or other seal such as latex rubber or silicone rubber. In some examples, the filter 1921 can comprise a particulate filter (e.g., a coconut fiber filer disk) to filter particulate from the liquid. In further examples, the filter 1921 can comprise a chemical filter (e.g., an activated charcoal filter disk). The sleeve 1925 can be designed for easy gripping to allow removal and insertion of the filter 1921 from the interior passage 1903.

Figure 31:
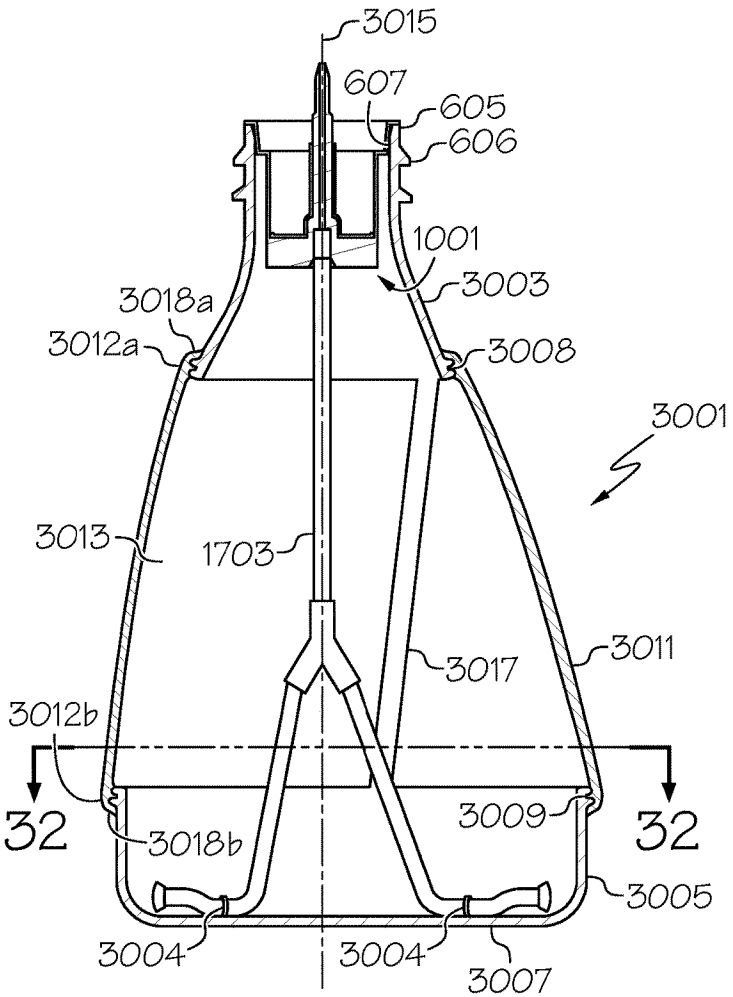
FIG. 31 illustrates the collapsible container of FIG. 30 in an extended orientation.

With reference to FIGS. 30-37, further embodiments can include a collapsible container 3001 that can be positioned in a collapsed orientation (See FIG. 30) and an extended orientation (See FIG. 31). The collapsible container 3001 includes a first shell 3003 including the mouth 605 defining the opening 607 and a first circumferential rim 3008. The collapsible container 3001 can further include a second shell 3005 including a closed end 3007 and a second circumferential rim 3009. The collapsible container can further include a circumferential bladder 3011 including a first edge 3012*a* sealed to the first circumferential rim 3008 and a second edge 3012*b* sealed to the second circumferential rim 3009. In some embodiments, the first edge 3012*a* is double sealed to the first circumferential rim 3008. For instance, as shown, the first circumferential rim 3008 may include a circumferential socket receiving a circumferential protrusion from the first edge 3012*a* of the circumferential bladder forming the first seal. In further embodiments, the first edge

3012*a* of the circumferential bladder may include a flap 3018*a* engaging an outer surface of the first shell 3003 forming the second seal. In some further embodiments, the second edge 3012*b* is double sealed to the second circumferential rim 3009. For instance, as shown, the second circumferential rim 3009 may include a circumferential socket receiving a circumferential protrusion from the second edge 3012*b* of the circumferential bladder forming the first seal. In further embodiments, the second edge 3012*b* of the circumferential bladder may include a flap 3018*b* engaging an outer surface of the second shell 3005 forming the second seal. The first and/or second seal may be further attached with adhesive or sonic welding to further enhance the integrity of the seal.

The first shell 3003, second shell 3005 and circumferential bladder 3011 define an interior containment area 3013 extending along an axis 3015 of the collapsible container 3001. In some embodiments, the axis 3015 can comprise a central axis (e.g., a symmetrical central axis) although the axis 3015 may comprise an offset axis (e.g., a symmetrical offset axis) that is offset from the central axis in further embodiments. In some embodiments, a material of the circumferential bladder 3011 includes a lower modulus of elasticity than a material of the first shell 3003 and a material of the second shell 3005. For example the first shell 3003 can comprise a wall formed from a first material, such as entirely formed from a first material, having a first modulus of elasticity. In some examples the second shell 3005 can be formed from a second material, such as entirely formed from a second material, having a second modulus of elasticity. In some examples, the first material and the second material are identical such that the first modulus of elasticity is identical to the second modulus of elasticity although different materials with different modulus of elasticity may be provided in further examples. In some embodiments, the first material and/or the second material can comprise a plastic, metal, resin. In further embodiments, the circumferential bladder 3011 may be formed from a third material, such as entirely formed from a third material, having a third modulus of elasticity that is less than both the first modulus of elasticity of the first shell 3003 and the second modulus of elasticity of the second shell 3005. As such, due to the fact that material defining the walls of the circumferential bladder 3011 has a modulus of elasticity that is less than the modulus of elasticity of the material defining the walls of the first and second shells 3003, 3005, the axial collapsibility of the circumferential bladder 3011 is higher than an axial collapsibility of both the first shell 3003 and the second shell 3005.

Figure 30:
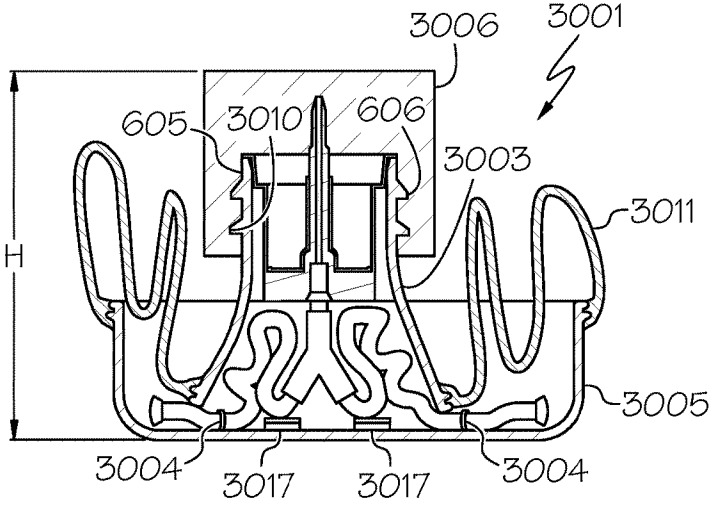
FIG. 30 illustrates a collapsible container in a collapsed orientation.
Figure 32:
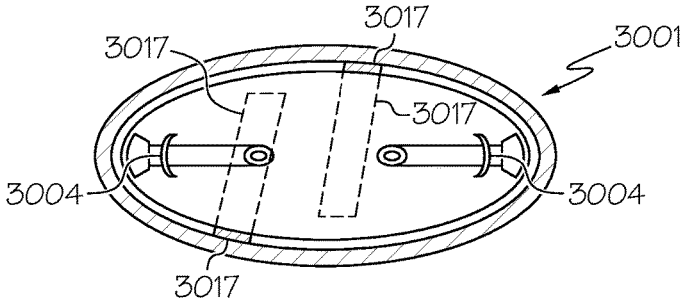
FIG. 32 illustrates a sectional view of the collapsible container along line 32-32 of FIG. 31.

In some embodiments, the first shell 3003 and the second shell 3005 can be connected together with at least one strap 3017. The strap 3017, if provided, can prevent over extension of the first shell 3003 and the second shell 3005 can thereby relieve stress that may otherwise be imposed on the seals between the circumferential bladder 3011 and the first and second shells 3003, 3005. Furthermore, the straps can be relatively thin so as not to interfere with the collapsibility of the collapsible container 3001. Still further, as shown in FIGS. 30 and 32, a pair of straps 3017 may be provided on each side of the container to provide attachment of opposed sides of the first and second shells 3003, 3005. Furthermore, as shown in FIG. 30 and in broken lines in FIG. 32, once collapsed, the straps 3017 can be arranged so that they do not fold on top of one another to maximize the collapsibility of the collapsible container 3001.

In some embodiments, the strap 3017 maybe integrally formed with the first shell 3003 and the second shell 3005. For example, the liquid container 601 illustrated in FIG. 6 may be formed and then machined to remove central portions of the liquid container, leaving behind the straps 3017 integrally formed with the first shell 3003 and the second shell 3005.

In some embodiments, the first shell 3003 can be shaped to nest within the second shell 3005. For instance, as shown in FIG. 30 and schematically in FIG. 34, a portion of the first shell 3003 is shaped to nest within a portion of the second shell 3005. Alternatively, as shown schematically in FIG. 36, a portion of the second shell 3005 may be nested within a portion of the first shell 3003. Nesting the shells with respect to one another can further reduce an overall height "H" (See FIG. 30) of the collapsible container 3001 in the collapsed orientation.

The circumferential bladder 3011 may comprise a wide variety of shapes. For instance, as shown in FIG. 31, the shape of the circumferential bladder can comprise a smooth continuous wall that is not stepped but might be circular cylindrical or conically tapered as illustrated. Such a configuration can allow collapsing of the bladder 3011 outside of the first shell 3003 and within the height "H" such that the collapsed bladder 3011 does not significantly contribute to the height "H" of the collapsed container 3001.

Figure 33:
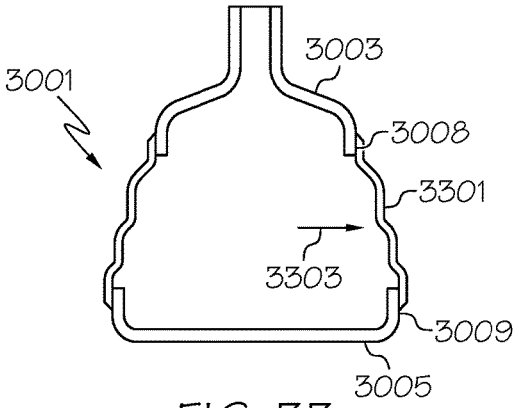
FIG. 33 schematically illustrates a collapsible container including a laterally stepped circumferential bladder in an extended orientation.

In further examples, as schematically shown in FIG. 33, the circumferential bladder 3301 can be radially stepped outwardly in a radial direction 3303 from the first circumferential rim 3008 to the second circumferential rim 3009. In further examples, as schematically shown in FIG. 35, the circumferential bladder 3501 can be radially stepped outwardly in a radial direction 3303 from the second circumferential rim 3009 to the first circumferential rim 3008. Providing radially stepped circumferential bladders 3301, 3501, as schematically shown in FIGS. 34 and 36, can help axially collapse the circumferential bladders in a nested relationship.

Figure 38:
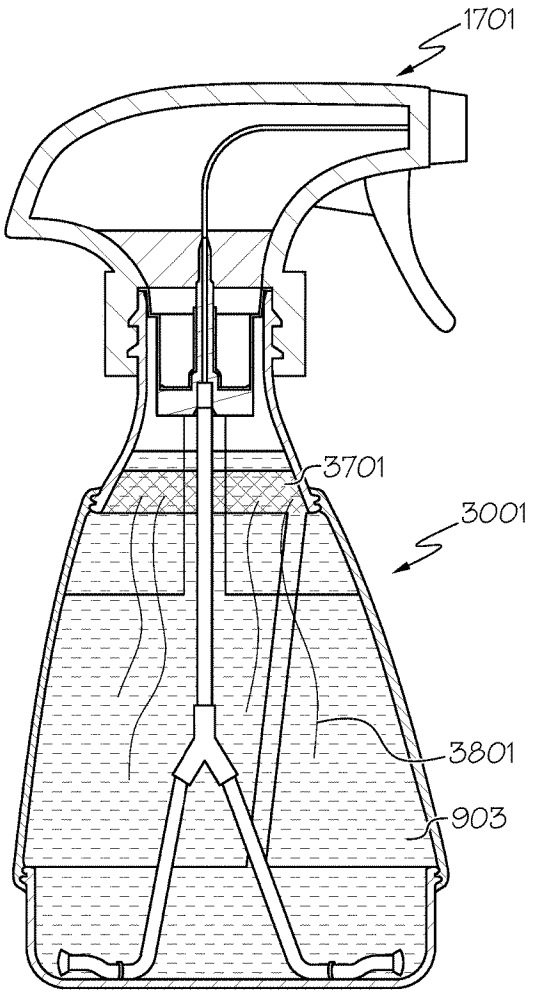
FIG. 38 illustrates applying a spray nozzle to the opening of the collapsible liquid container of FIG. 37.
Figure 37:
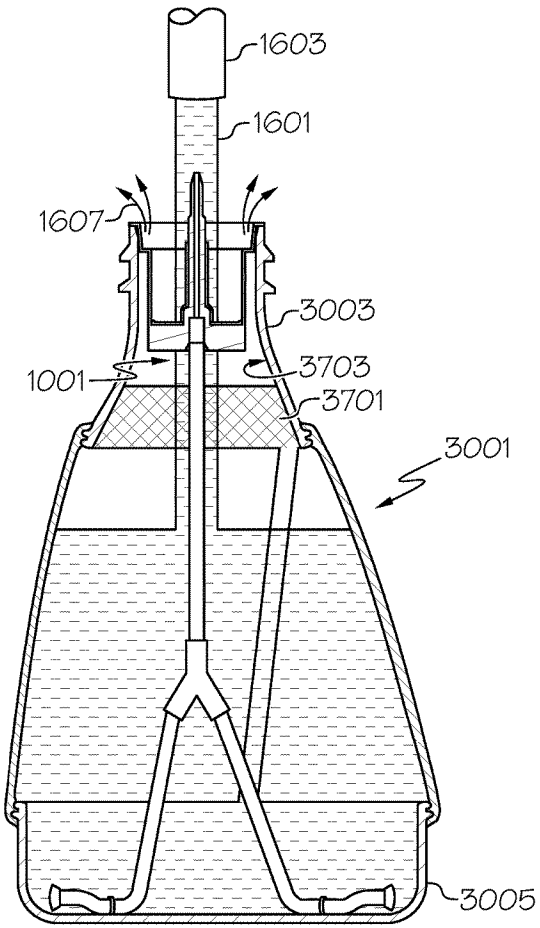
FIG. 37 illustrates a step of adding liquid, such as water, to a container to dilute an additive in the liquid container into a mixture.

Referring to FIG. 37, in some embodiments, the collapsible container 3001 can provide an additive 3701 coated on an inner surface 3703 of the first shell 3003. In further examples, the second shell 3005 does not include the coating of additive on the inner surface of the second shell 3005. Providing the additive 3701 only coated on the inner surface of the first shell 3003 can minimize mixing of the additive until the liquid 1601 fills the liquid container to avoid foaming that may otherwise occur if the additive mixes with the liquid 1601 during the filling process. Such coating of additive on the inner surface may be provided in an upper portion of the liquid container 601 discussed previously to provide foam reduction benefits to filling the liquid container 601. As shown in FIG. 38, a significant portion of the additive 3701 is designed to dissolve as indicated at 3801 to form the mixture 903 after the bottle is filled with the liquid 1601.

Figure 34:
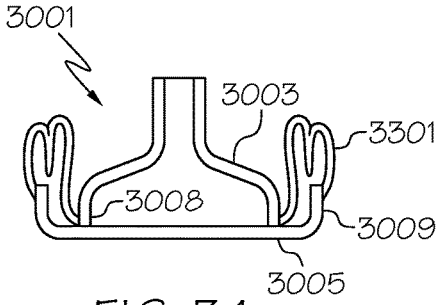
FIG. 34 schematically illustrates the collapsible container of FIG. 33 in a collapsed orientation.
Figure 35:
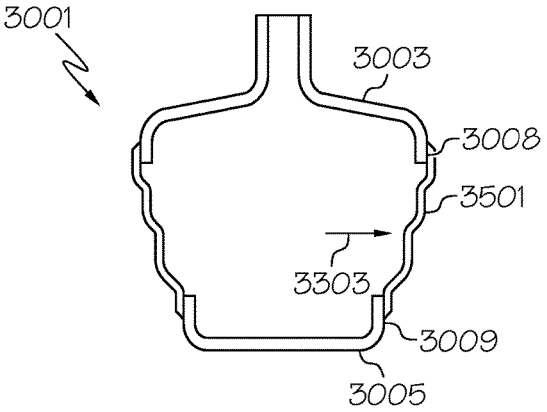
FIG. 35 schematically illustrates another collapsible container including another laterally stepped circumferential bladder in an extended orientation.
Figure 36:
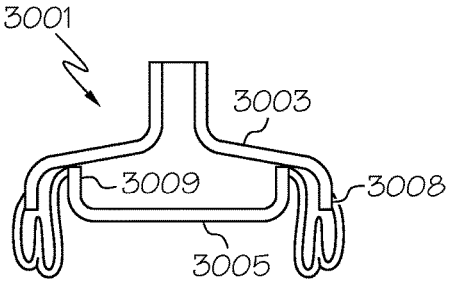
FIG. 36 schematically illustrates the collapsible container of FIG. 35 in a collapsed orientation.

In some embodiments, the collapsible container 3001 discussed above, may be provided as the collapsed container shown, for example, in FIG. 30, 34 or 36. For purposes of discussion, the collapsed container 3001 illustrated in FIG. 30 will be discussed. As shown, the collapsed container can comprise the collapsible container 3001 discussed above with the circumferential bladder 3011 comprising the collapsed circumferential bladder illustrated in FIG. 30. In some examples, the collapsed container 3001 can be provided during transport from a manufacturing facility to reduce the size of the package and therefore the cost of shipment of multiple collapsed containers. As shown, the collapsed container illustrated in FIG. 30 may include a cap 3006. As shown, in some embodiments, the cap 3006 may include interior threads 3010 that engage the exterior threads 606 of the mouth 605. As such, the cap 3006 may be screwed on the mouth 605. Once properly screwed in place, the cap 3006 can prevent air from entering into the interior containment area 3013 of the collapsible container 3001, thereby assisting in maintaining the container in the collapsed state until the cap 3006 is removed. Indeed, a lower pressure may develop in the interior containment area 3013 that prevents significant extension of the collapsible container until the cap 3006 is removed. Once removed, the circumferential bladder 3011 and/or the straps 3017 may help bias the collapsible container into the extended orientation illustrated in FIG. 31.

In some embodiments, the collapsible container may include a mouth fill device, such as the illustrated mouth fill device 1001, 2201, 2601. If provided, the mouth fill device can provide the same benefits described with respect to the liquid container discussed previously. Furthermore, as shown, if a dip tube 1703 is provided, one or more ends of the dip tube may be attached to the second shell 3005. Attaching can help maintain the end(s) of the dip tube 1703 in a proper orientation so that collapsing the collapsible container does not relocate the end(s) of the dip tube 1703 in an orientation that is not desired. In embodiments with a dip tube 1703 that includes two or more ends, one or all of the ends may be attached to the second shell 3005. In further embodiments, the end of a dip tube having only a single end may also be attached to the second shell 3005. In some embodiments, an end cap attached to the end of the one or more dip tubes may be integrated with the second shell 3005. Alternatively, as shown, each end of the dip tube may be fastened with a fastener 3004 such as the illustrated tie-down.

Furthermore, an applicator apparatus 101 may be provided to facilitate introduction of additive 111 to the collapsible container 3001. Such applicator apparatus 101 may be designed for initial introduction of additive to the container. Alternatively, if the collapsed container shown in FIG. 30 is provided with the additive 3701 coated on the interior surface of the first shell 3003 as discussed above, the additive 3701 may be sufficient for the initial filling of the collapsible container while the applicator apparatus 101 may be used when refilling the collapsible container 3001.

EXAMPLE EMBODIMENTS

Some example embodiments of the disclosure are described below with the understanding that any of the embodiments may be used alone or in combination with one another.

Embodiment 1

An applicator apparatus 101 can include a circumferential wall 103 including an interior surface 201 defining an interior passage 202 extending along an axis 203 of the circumferential wall 103. The applicator apparatus 101 can include a support arm 205 movably mounted relative to the circumferential wall 103 within the interior passage 202. The support arm 205 can include a first end 215*a* engaging the interior surface 201 at a first location 204*a*, a second end 215*b* engaging the interior surface 201 at a second location 204*b* spaced from the first location 204*a*, and a protrusion 207 extending in an axial direction 219 of the axis 203 within the interior passage 202.

Embodiment 2

The applicator apparatus 101 according to embodiment 1, further including an additive container 105 mounted to a first end portion 209 of the circumferential wall 103. The additive container 105 includes a container wall 107 defining an interior containment area 109 of the additive container 105.

Embodiment 3

The applicator apparatus 101 according to embodiment 2, wherein the container wall 107 includes a target area 229 facing the interior passage 202 to be pierced by the protrusion upon a movement of the support arm 205 relative to the circumferential wall 103.

Embodiment 4

The applicator apparatus 101 according to embodiment 2, wherein the circumferential wall 103 defines a second end portion 213 that is opposite the first end portion 209. The second end portion 213 defines an opening 211 into the interior passage 202.

Embodiment 5

The applicator apparatus 101 according to embodiment 4, wherein the opening 211 into the interior passage 202 is flared in an outward direction 217 extending from the first end portion 209 to the second end portion 213.

Embodiment 6

The applicator apparatus 101 according to any one of embodiments 1-5, wherein the support arm 205 is press fit within the interior passage 202.

Embodiment 7

The applicator apparatus 101 according to any one of embodiments 1-6, wherein the first end 215*a* of the support arm 205 and the second end 215*b* of the support arm 205 each slidingly engages the interior surface 201.

Embodiment 8

The applicator apparatus 101 according to any one of embodiments 1-7, wherein the support arm 205 includes a plurality of segments including a first segment 503*a* including the first end 215*a*, a second segment 503*b* including the second end 215*b* and a third segment 503*c* including a third end 215*c*. The third end 215*c* engages the interior surface 201 at a third location 204*c* spaced from the first location 204*a* and the second location 204*b*.

Embodiment 9

The applicator apparatus 101 according to embodiment 8, wherein the plurality of segments includes a fourth segment 503*d* including a fourth end 215*d*. The fourth end 215*d* engages the interior surface 201 at a fourth location 204*d* spaced from the first location 204*a*, the second location 204*b* and the third location 204*c*.

Embodiment 10

The applicator apparatus 101 according to embodiment 9, wherein a first two segments 503*a*-*b* of the plurality of segments extends along a first linear segment axis 505*a*, a second two segments 503*c*-*d* of the plurality of segments extends along a second linear segment axis 505*b*, and the first linear segment axis 505*a* intersects the second linear segment axis 505*b* at a 90° angle.

Embodiment 11

A method of assembling including providing an applicator apparatus 101 with a circumferential wall 103 including an interior surface 201 defining an interior passage 202 extending along the axis 203 of the circumferential wall 103. An additive container 105 is mounted to a first end portion 209 of the circumferential wall 103. The additive container 105 includes a container wall 107 defining an interior containment area 109 of the additive container 105. The container wall 107 includes a target area 229 facing the interior passage 202. The circumferential wall 103 further defines a second end portion 213 that is opposite the first end portion 209, and the second end portion 213 defines an opening 211 into the interior passage 202. The method includes inserting a support arm 205 through the opening 211 and then into the interior passage 202 with a protrusion 207 of the support arm 205 extending in a direction 219 of the axis 203 toward the target area 229. A first end 215*a* of the support arm 205 movably engages the interior surface 201 at a first location 204*a* and a second end 215*b* of the support arm 205 movably engages the interior surface 201 at a second location 204*b* spaced from the first location 204*a*.

Embodiment 12

The method according to embodiment 11, wherein the step of providing the applicator apparatus 101 includes obtaining a prefabricated applicator apparatus 101 wherein the additive container 105 was previously mounted to the first end portion 209 of the circumferential wall 103.

Embodiment 13

The method according to embodiment 11, wherein the step of providing the applicator apparatus 101 includes mounting the additive container 105 to the first end portion 209 of the circumferential wall 103.

Embodiment 14

The method according to embodiment 13, wherein the step of inserting the support arm 205 occurs after the step of mounting the additive container 105 to the first end portion 209 of the circumferential wall 103.

Embodiment 15

The method according to any one of embodiments 11-14, wherein the step of inserting the support arm 205 includes press fitting the support arm 205 within the interior passage 202.

Embodiment 16

The method according to any one of embodiments 11-15, wherein the step of inserting the support arm 205 includes sliding each of the first end 215*a* of the support arm 205 and the second end 215*b* of the support arm 205 against the interior surface 201.

Embodiment 17

A method of introducing an additive 111 including positioning a mouth 605 of a liquid container 601 into an interior passage 202 defined by a circumferential wall 103 of an applicator apparatus 101. An additive container 105 is attached to the circumferential wall 103 and is placed at a dispensing position relative to an opening 607 defined by a mouth 605 of the liquid container 601. The method includes driving a protrusion 207, 1103 relative to the additive container 105 to pierce a target area 229 of a container wall 107 of the additive container 105 such that additive 111 drains from an interior containment area 109 of the additive container 105, through the opening 607 of the mouth 605 and then into an interior containment area 603 of the liquid container 601.

Embodiment 18

The method according to embodiment 17, further including movably mounting a support arm 205 relative to the circumferential wall 103. Driving the protrusion 207 includes axially moving the additive container 105 relative to the liquid container 601 such that the mouth 605 of the liquid container 601 drives the support arm 205 relative to the additive container 105 to pierce the target area 229 with the protrusion 207.

Embodiment 19

The method according to embodiment 17, wherein the protrusion 1103 is fixedly mounted with respect to the mouth 605 of the liquid container 601. Driving the protrusion 1103 includes axially moving the additive container 105 relative to the liquid container 601 such that protrusion 1103 pierces the target area 229 while the protrusion 1103 remains fixedly mounted with respect to the mouth 605.

Embodiment 20

The method according to embodiment 19, wherein the protrusion 1103 includes an interior passageway 1905. A liquid dispensing path of the liquid container 601 is defined by the interior passageway 1905 of the protrusion 1103 and an interior channel of a dip tube 1703 extending into the interior containment area 603 of the liquid container 601.

Embodiment 21

A mouth fill device 1001, 2201, 2601 to be mounted with respect to a mouth 605 of a liquid container 601. The mouth fill device 1001, 2201, 2601 includes a circumferential shroud 1801 circumscribing an axis 1803 of the mouth fill device 1001, 2201, 2601. The circumferential shroud 1801 includes an interior surface 1901 defining an interior passage 1903 extending along the axis 1803. A circumferential lip 1807 circumscribes an end 1906 of the circumferential shroud 1801 and extends radially away from the axis 1803. The circumferential lip 1807 includes a plurality of apertures 2001 disposed about the axis 1803.

Embodiment 22

The mouth fill device 1001, 2201, 2601 according to embodiment 21, further including a frustoconical flange 1817 extending from an outer periphery 1819 of the circumferential lip 1807 in a direction extending away from the circumferential shroud 1801.

Embodiment 23

The mouth fill device 1001, 2201, 2601 according to any one of embodiments 21-22, further including a dip tube port 1907 mounted relative to the circumferential shroud 1801.

Embodiment 24

The mouth fill device 1001, 2201, 2601 according to embodiment 23, further including a dip tube 1703 including an end 1704 mounted within the dip tube port 1907.

Embodiment 25

The mouth fill device 1001 according to any one of embodiments 23-24, wherein the dip tube port 1907 is located within the interior passage 1903.

Embodiment 26

The mouth fill device 1001, 2201, 2601 according to any one of embodiments 23-25, further comprising at least one support arm 1911*a-d* including one end connected relative to the dip tube port 1907 and another end connected relative to the circumferential shroud 1801.

Embodiment 27

The mouth fill device 1001, 2201 according to any one of embodiments 21-22, further including a protrusion 1103 mounted relative to the circumferential shroud 1801 and extending within the interior passage 1903.

Embodiment 28

The mouth fill device 1001, 2201, 2601 according to embodiment 27, further including a dip tube port 1907 mounted relative to the circumferential shroud 1801.

Embodiment 29

The mouth fill device 1001, 2201, 2601 according to embodiment 28, further including a dip tube 1703 including an end 1704 mounted within the dip tube port 1703.

Embodiment 30

The mouth fill device 1001, 2201 according to embodiment 29, wherein the protrusion 1103 includes an interior passageway 1905, wherein a liquid dispensing path is defined by the interior passageway 1905 of the protrusion 1103 and an interior channel of a dip tube 1703.

Embodiment 31

The mouth fill device 1001, 2201 according to any one of embodiments 27-30, wherein the axis 1803 comprises a central axis extending through the protrusion 1103.

Embodiment 32

The mouth fill device 1001, 2201 according to any one of embodiments 27-31, further comprising at least one support arm 1911*a-d* including one end connected relative to the protrusion 1103 and another end connected relative to the circumferential shroud 1801.

Embodiment 33

A liquid container 601 including a mouth 605 and the mouth fill device 1001, 2201, 2601 of any one of embodiments 21-32 mounted with respect to the mouth 605 of the liquid container 601.

Embodiment 34

A mouth fill device 1001, 2201 to be mounted with respect to a mouth 605 of a liquid container 601. The mouth fill device 1001, 2201 includes a circumferential shroud 1801 circumscribing an axis 1803 of the mouth fill device 1001, 2201. The circumferential shroud 1801 includes an interior surface 1901 defining an interior passage 1903 extending along the axis 1803. A protrusion 1103 is mounted relative to the circumferential shroud 1801 and extends within the interior passage 1903.

Embodiment 35

The mouth fill device 1001, 2201 according to embodiment 34, wherein the axis 1803 comprises a central axis extending through the protrusion 1103.

Embodiment 36

The mouth fill device 1001, 2201 according to any one of embodiments 34 and 35, further comprising a dip tube port 1907 mounted relative to the circumferential shroud 1801.

Embodiment 37

The mouth fill device 1001, 2201 according to embodiment 36, further including a dip tube 1703 including an end 1704 mounted to the dip tube port 1907.

Embodiment 38

The mouth fill device 1001, 2201 according to embodiment 37, wherein the protrusion 1103 includes an interior passageway 1905. A liquid dispensing path is defined by the interior passageway 1905 of the protrusion 1103 and an interior channel of the dip tube 1703.

Embodiment 39

A liquid container 601 including a mouth 605 and the mouth fill device 1001, 2201 of any one of embodiments 34-38 mounted with respect to the mouth 605 of the liquid container 601.

Embodiment 40

The liquid container 601 of any one of embodiments 33 and 39, further including a spray nozzle 1701 mounted to the mouth 605 of the liquid container 601.

Embodiment 41

The liquid container 601 of any one of embodiments 33, 39 and 40, further including a filter 1921 mounted with respect to the circumferential shroud 1801.

Embodiment 42

A collapsible container 3001 including a first shell 3003 including a mouth 605 defining an opening 607 and a first circumferential rim 3008. The collapsible container 3001 further includes a second shell 3005 including a closed end 3007 and a second circumferential rim 3009. The collapsible container 3001 further includes a circumferential bladder 3011, 3301, 3501 including a first edge 3012*a* sealed to the first circumferential rim 3008 and a second edge 3012*b* sealed to the second circumferential rim 3009. The first shell 3003, second shell 3005 and circumferential bladder 3011, 3301, 3501 define an interior containment area 3013 extending along an axis 3015 of the collapsible container 3001. A material of the circumferential bladder 3011, 3301, 3501 includes a lower modulus of elasticity than a material of the first shell 3003 and a material of the second shell 3005. An axial collapsibility of the circumferential bladder 3011, 3301, 3501 is higher than the axial collapsibility of both the first shell 3003 and the second shell 3005.

Embodiment 43

The collapsible container 3001 of embodiment 42, further including at least one strap 3017 connecting the first shell 3003 and the second shell 3005.

Embodiment 44

The collapsible container 3001 of embodiment 43, wherein the at least one strap 3017 is integrally formed with the first shell 3003 and the second shell 3005.

Embodiment 45

The collapsible container 3001 of any one of embodiments 42-44, wherein the first shell 3003 is shaped to nest within the second shell 3005.

Embodiment 46

The collapsible container 3001 of embodiment 45, wherein the circumferential bladder 3301 is radially stepped outwardly in a radial direction 3303 from the first circumferential rim 3008 to the second circumferential rim 3009.

Embodiment 47

The collapsible container 3001 of any one of embodiments 42-44, wherein the second shell 3005 is shaped to nest within the first shell 3003.

Embodiment 48

The collapsible container 3001 of embodiment 47, wherein the circumferential bladder 3501 is radially stepped outwardly in a radial direction 3303 from the second circumferential rim 3009 to the first circumferential rim 3008.

Embodiment 49

The collapsible container 3001 of any one of embodiments 42-48, wherein an inner surface of the first shell 3003 includes a coating of additive 3701 to mix with liquid 1601 to be filled within the liquid container 601.

Embodiment 50

The collapsible container 3001 of embodiment 49 wherein the second shell 3005 does not include a coating of additive.

Embodiment 51

The collapsible container 3001 of any one of embodiments 42-50, wherein the first edge 3012*a* is double sealed to the first circumferential rim 3008.

Embodiment 52

The collapsible container 3001 of any one of embodiments 42-51, wherein the second edge 3012*b* is double sealed to the second circumferential rim 3009.

Embodiment 53

A collapsed container 3001 including a first shell 3003 including a mouth 605 defining an opening 607 and a first circumferential rim 3008 and a second shell 3005 including a closed end 3007 and a second circumferential rim 3009. The collapsed container 3001 further includes an axially collapsed circumferential bladder 3011, 3301, 3501 including a first edge 3012*a* sealed to the first circumferential rim 3008 and a second edge sealed to the second circumferential rim 3009. The first shell 3003, second shell 3005 and circumferential bladder 3011, 3301, 3501 define an interior containment area 3013 extending along an axis 3015 of the collapsed container 3001. A material of the circumferential bladder 3011, 3301, 3501 includes a lower modulus of elasticity than a material of the first shell 3003 and a material of the second shell 3005 wherein the axial collapsibility of the circumferential bladder 3011, 3301, 3501 is higher than the axial collapsibility of both the first shell 3003 and the second shell 3005.

Embodiment 54

The collapsed container 3001 of embodiment 53, wherein a pressure within the interior containment area 3013 biases the collapsed container 3001 in a collapsed orientation.

Embodiment 55

The collapsed container 3001 of any one of embodiments 53 and 54, further including at least one strap 3017 connecting the first shell 3003 and the second shell 3005.

Embodiment 56

The collapsed container 3001 of embodiment 55, wherein the at least one strap 3017 is integrally formed with the first shell 3003 and the second shell 3005.

Embodiment 57

The collapsed container 3001 of any one of embodiments 53-56, wherein the first shell 3003 is nested within the second shell 3005.

Embodiment 58

The collapsed container of embodiment 57, wherein the axially collapsed circumferential bladder 3301 is radially stepped outwardly in a radial direction 3303 from the first circumferential rim 3008 to the second circumferential rim 3009.

Embodiment 59

The collapsed container 3001 of any one of embodiments 53-56, wherein the second shell 3005 is nested within the first shell 3003.

Embodiment 60

The collapsed container 3001 of embodiment 59, wherein the axially collapsed circumferential bladder 3501 is radially stepped outwardly in a radial direction 3303 from the second circumferential rim 3009 to the first circumferential rim 3008.

Embodiment 61

The collapsed container 3001 of any one of embodiments 53-60, wherein an inner surface 3703 of the first shell 3003 includes a coating of additive 3701 to mix with liquid 1601 to be filled within the liquid container 601.

Embodiment 62

The collapsed container 3001 of embodiment 61 wherein the second shell 3005 does not include a coating of additive.

Embodiment 63

The collapsed container 3001 of any one of embodiments 53-62, wherein the first edge 3012*a* is double sealed to the first circumferential rim 3008.

Embodiment 64

The collapsed container 3001 of any one of embodiments 53-63, wherein the second edge 3012*b* is double sealed to the second circumferential rim 3009.

It should be understood that while various embodiments have been described in detail with respect to certain illustrative and specific examples thereof, the present disclosure should not be considered limited to such, as numerous modifications and combinations of the disclosed features are possible without departing from the scope of the following claims.

What is claimed is:

1. A mouth fill device to be mounted with respect to a mouth of a liquid container, the mouth fill device including:

a circumferential shroud circumscribing an axis of the mouth fill device, wherein the circumferential shroud includes an interior surface defining an interior passage extending along the axis, the interior passage including a liquid fill passage;

a dip tube port mounted relative to the circumferential shroud, the dip tube port defines a liquid dispensing passage, and the fluid fill passage is disposed outside of the liquid dispensing passage; and a circumferential lip circumscribing an end of the circumferential shroud and extending radially away from the axis, the circumferential lip including a plurality of apertures disposed about the axis and outside of the liquid fill passage.

2. The mouth fill device according to claim 1, further comprising a frustoconical flange extending from an outer periphery of the circumferential lip in a direction extending away from the circumferential shroud.

3. The mouth fill device according to claim 1, further including a dip tube including an end mounted within the dip tube port, wherein the dip tube includes an interior channel further defining the liquid dispensing passage.

4. The mouth fill device according to claim 1, wherein the dip tube port is located within the interior passage.

5. The mouth fill device according to claim 1, further including a protrusion mounted relative to the circumferential shroud and extending within the interior passage, and the protrusion including an interior passageway extending through the protrusion that further defines the liquid dispensing passage.

6. A liquid container including a mouth and the mouth fill device according to claim 1 mounted with respect to the mouth of the liquid container.

7. The liquid container according to claim 6, further including a filter mounted with respect to the circumferential flange.

8. The mouth fill device according to claim 1, further comprising at least one support arm including one end connected relative to the dip tube port and another end connected relative to the circumferential shroud.

9. The mouth fill device according to claim 8, wherein the at least one support arm passes through the liquid fill passage.

10. The mouth fill device according to claim 5, wherein the axis comprises a central axis of the mouth fill device that extends through the protrusion.

11. The mouth fill device according to claim 5, further comprising at least one support arm including one end connected relative to the protrusion and another end connected relative to the circumferential shroud.

12. The mouth fill device according to claim 5, further including a dip tube including an end mounted within the dip tube port, wherein the dip tube includes an interior channel further defining the liquid dispensing passage.

13. A mouth fill device to be mounted with respect to a mouth of a liquid container, the mouth fill device including:

a circumferential shroud circumscribing an axis of the mouth fill device, wherein the circumferential shroud includes an interior surface defining an interior passage extending along the axis, the interior passage including a liquid fill passage;

a dip tube port mounted relative to the circumferential shroud, the dip tube port defines a liquid dispensing passage, and the fluid fill passage is disposed outside of the liquid dispensing passage;

a protrusion mounted relative to the circumferential shroud and extending within the interior passage, the protrusion including an interior passageway extending through the protrusion that further defines the liquid dispensing passage, and the protrusion including an interface surface; and a circumferential lip circumscribing an end of the circumferential shroud and extending radially away from the axis, the circumferential lip including a plurality of apertures disposed about the axis and outside of the liquid fill passage.

14. The mouth fill device according to claim 13, wherein the interface surface includes a frustoconical surface that flares outwardly in a direction of the axis from a first diameter of a first protrusion segment of the protrusion to a second diameter of a second protrusion segment of the protrusion.

15. The mouth fill device according to claim 13, further including a dip tube including an end mounted within the dip tube port, wherein the dip tube includes an interior channel further defining the liquid dispensing passage.

16. A liquid container including a mouth and the mouth fill device according to claim 13 mounted with respect to the mouth of the liquid container.

17. The liquid container according to claim 16, wherein the mouth fill device further includes a dip tube including an end mounted within the dip tube port, wherein the dip tube extends within an interior of the liquid container and includes an interior channel further defining the liquid dispensing passage.

18. The liquid container according to claim 16, further comprising a spray head mounted to the mouth of the liquid container with an interface connection existing between an interface surface of the spray head and the interface surface of the protrusion.

19. The liquid container according to claim 18, wherein the interface surface of the protrusion comprises a frustoconical surface and the interface surface of the spray head comprises a frustoconical surface.

20. The liquid container according to claim 19, wherein the interface connection is provided by the frustoconical surface of the protrusion being received by the frustoconical surface of the spray head.

* * * * *